US006777175B2

(12) United States Patent
Yamazaki et al.

(10) Patent No.: US 6,777,175 B2
(45) Date of Patent: Aug. 17, 2004

(54) SILVER HALIDE PHOTOGRAPHIC MATERIAL FOR DIRECT OBSERVATION AND INK-JET RECORDING SHEET

(75) Inventors: Katsumasa Yamazaki, Odawara (JP); Toyoki Nishijima, Odawara (JP)

(73) Assignee: Konica Corporation, Tokyo (JP)

( * ) Notice: Subject to any disclaimer, the term of this patent is extended or adjusted under 35 U.S.C. 154(b) by 0 days.

(21) Appl. No.: 10/357,096

(22) Filed: Feb. 3, 2003

(65) Prior Publication Data

US 2003/0215761 A1 Nov. 20, 2003

(30) Foreign Application Priority Data

Feb. 13, 2002 (JP) ..... 2002-035199

(51) Int. Cl.[7] ..... G03C 1/005; G03C 1/494

(52) U.S. Cl. ..... 430/572; 430/517; 430/519; 430/520; 430/521; 430/522; 430/508

(58) Field of Search ..... 430/572, 517, 430/519–522, 508

(56) References Cited

U.S. PATENT DOCUMENTS

2004/0005520 A1 * 1/2004 Sakai ..... 430/517

* cited by examiner

*Primary Examiner*—Geraldine Letscher
(74) *Attorney, Agent, or Firm*—Frishauf, Holtz, Goodman & Chick, P.C.

(57) ABSTRACT

A silver halide photographic material for direct observation comprising a support having on one side of the support, (a) a photosensitive layer comprising a silver halide emulsion; and (b) a non-photosensitive layer, wherein the photographic material comprises at least one oil-soluble dye having a maximum absorption wavelength of a spectral reflection density curve in a range of 540 to 580 nm and exhibiting an absorption density at 440 nm of not more than ¼ of an absorption density at the maximum absorption wavelength.

10 Claims, No Drawings

SILVER HALIDE PHOTOGRAPHIC MATERIAL FOR DIRECT OBSERVATION AND INK-JET RECORDING SHEET

FIELD OF THE INVENTION

The present invention relates to a silver halide photographic material for direct observation and an ink-jet recording sheet which exhibits a high lightness and an optimal white background together with improved viewing light source dependency of the white background and also excellent sharpness.

BACKGROUND OF THE INVENTION

A silver halide photographic material for direct observation (hereinafter, also referred to as a photographic material) is composed of a silver halide emulsion layer on a support provided with a subbing layer.

RC paper is known as a typical support used for a silver halide photographic material for direct observation. In addition, there are a transparent oriented polyethylene terephthalate base, a white oriented polyethylene terephthalate base, an oriented polypropylene base and a cellulose triacetate base.

RC paper is comprised of a paper base of which both sides are laminated with polymer layers such as polyolefin, typically polyethylene layers (hereinafter, also referred to as PE layers). A PE layer provides waterproofing to RC paper and also is useful to provide a smooth surface for a light-sensitive silver halide emulsion layer formed after coating a silver halide emulsion layer.

As a PE layer on RC paper used for photographic material, usually employed is titanium dioxide and other white pigments added into the PE layer of a silver halide emulsion layer coating side (hereinafter, also referred to as a surface PE layer). Since the white background after photographic processing is preferred by consumers to be a slightly bluish white, a coloring agent and a fluorescent brightening agent may appropriately be added into the surface PE layer.

Meanwhile, in cases when PE is laminated on a paper base, a melt extrusion method after high temperature treatment of the PE is commonly employed. Since the temperature of high temperature treatment of PE is usually more than 290° C., additives to PE such as white pigments, coloring agents and fluorescent brightening agents have to be extremely stable chemically and also in color. Thus, the closest attention is paid to selecting additives, which usually are quite expensive.

Even when the most appropriate selection is made, some defects such as aggregation of a coloring agent or bleed-out of a fluorescent brightening agent may occur in the rare occasions, resulting in spots on the image after processing of the photographic material. Special high-temperature filtration may be required to minimize the undesirable aggregation, and requiring tremendous attention and undesired expenses.

Consequently, a photographic material obtaining the most appropriate white background after photographic processing is desired, in which the expensive RC paper containing a coloring agent and a fluorescent brightening agent in a surface PE layer is not employed.

Further, blending of PE, white pigments and coloring agents is usually accomplished before extrusion of a PE layer onto a paper base. Consequently, in cases when changes of color are required to adjust to some color change of RC paper or successive image forming layers, it is basically impossible to change the color.

For the above-mentioned problems of a white background adjusting methods of RC paper, methods to adjust a white background by addition of a waterproof dye or pigment into the emulsion layer are proposed in JP-A 2-842 and JP-A 2001-75231 (hereinafter, the term JP-A means Japanese Patent Application Publication). In these cases, adjusting to a slightly bluish white background is accompanied by very large decrease in lightness, and even then the preferred white background cannot be obtained.

Further, a support other than RC paper, for example, a white polyethylene terephthalate base containing voids usually does not contain a coloring agent and exhibits a different white background from that of RC paper containing a coloring agent in the surface PE layer, and the white background of the photographic material after photographic processing differs as a result.

As mentioned above, a photographic material capable of exhibiting a stable white background is required even when PC paper or the image forming layer varies, or the support is a different type.

Meanwhile, light sources vary where printed images of photographic materials are observed. Shades of color vary depending on light sources such as sunlight through a window, tungsten light and fluorescent light, and differences in vision of white background also vary with light sources. In the past, light source dependency of white background was rarely considered, however, lessening of light source dependency of white background is now important when excellent printed images are required.

In image quality of photographic materials, demand for higher quality images is increasing due to popularization of color print paper. In this situation, studies of color reproduction, tone reproduction, improved sharpness and glossiness of color print paper have widely been achieved.

Irradiation and halation are generally known as factors of print image sharpness. The former is caused by scattering of incident light by silver halide particles and oil particles of couplers dispersed in gelatin layers, and the degree depends mainly on the gelatin content, silver halide coverage and oil particle volume. The latter depends on the degree of reflection from the support, as well as depending on reflectance and refraction index of the support.

Anti-irradiation has been enhanced by addition of a water-soluble dye. The improvements are described in JP-A Nos. 50-145125, 52-20830, 50-111641, 61-148448, 61-151650, 62-275562 and 62-283336.

Anti-halation is known to provide an anti-halation layer. Examples of these improvements are described in JP-A Nos. 55-33172, 59-193447, 59-151650 and 62-33448.

However, these methods have caused a tremendous decrease of sensitivity, even with improvement of sharpness. With these means only, it was a difficult to enhance sharpness while maintaining practically sufficient sensitivity.

Color printed images are comprised of cyan images, magenta images and yellow images, and sharpness of yellow images is the most superior and that of cyan images is the most inferior. This result is caused by that a yellow image layer is usually in the nearest image layer to a support and a cyan image layer is in the farthest image layer from the support.

Meanwhile, sharpness of 3 color images is preferably on par with each other as much as possible in terms of print quality. It is desired that 3 color images exhibit high sharpness, however relative sharpness of the 3 color images is approximate.

Further, the degree of the white background is an important property, as it is also in an ink-jet recording sheet, and adjustments have been accomplished. A resin coated paper support is employed for high quality ink-jet recording sheet, and a white pigment is added into the resin of a support to increase whiteness and opacity. The particles containing fine voids are often added in high volume in an ink absorbing layer to absorb ink. Thus, further addition of an additive to adjust tint of white background tends to cause surface defects, resulting in the necessity of using a highly effective additive as a consequence.

SUMMARY OF THE INVENTION

The inventors' study resulted in achieving an ink-jet recording sheet exhibiting high lightness and a most appropriate white background. Also, an ink-jet recording sheet exhibiting improved viewing light source dependency of white background was obtained.

The first object of this invention is to provide a silver halide photographic material for direct observation which is low in cost, exhibits high lightness and a most appropriate white background. The second object of this invention is to provide a silver halide photographic material for direct observation which exhibits excellent sharpness. The third object of this invention is to provide a silver halide photographic material for direct observation which exhibits improved viewing light source dependency of the white background. The fourth object of this invention is to provide an ink-jet recording sheet which exhibits high lightness whiteness. The fifth object of this invention is to provide an ink-jet recording sheet in which whiteness varies only slightly little even when the viewing light source varies.

The foregoing objects of the present invention can be accomplished by the following embodiments.

1. A silver halide photographic material for direct observation comprising a support having on one side of the support, p1 (a) a photosensitive layer comprising a silver halide emulsion; and (b) a non-photosensitive layer, wherein the photographic material comprises at least one oil-soluble dye having a maximum absorption wavelength of a spectral reflection density curve in a range of 540 to 580 nm and exhibiting an absorption density at 440 nm of not more than ¼ of an absorption density at the maximum absorption wavelength.

2. A silver halide photographic material for direct observation comprising a support having on one side of the support, (a) a photosensitive layer comprising a silver halide emulsion; and (b) a non-photosensitive layer, wherein the photographic material comprises two oil-soluble dyes each having a maximum absorption wavelength of a spectral reflection density curve in a range of 550 to 645 nm.

3. A silver halide photographic material for direct observation comprising a support having on one side of the support, (a) a photosensitive layer comprising a silver halide emulsion; and (b) a non-photosensitive layer, wherein the photographic material comprises two oil-soluble dyes each having an absorption density at 440 nm of a spectral reflection density curve of not more than ⅕ of an absorption density at a maximum absorption wavelength.

4. The silver halide photographic material of item 1, comprising a first oil-soluble dye having a hue angle $h_{ab}$ of 270 to 350 degree defined in a CIELAB color space and a second oil-soluble dye having a hue angle $h_{ab}$ of 240 to 320 degree, each hue angle $h_{ab}$ being measured using a normalized spectral transparent density curve obtained from a test sample having a reflective support coated thereon with the first oil-soluble dye or the second oil-soluble dye.

5. The silver halide photographic material of item 2, comprising a first oil-soluble dye having a hue angle $h_{ab}$ of 270 to 350 degree defined in a CIELAB color space and a second oil-soluble dye having a hue angle $h_{ab}$ of 240 to 320 degree, each hue angle $h_{ab}$ being measured using a normalized spectral transparent density curve obtained from a sample coated with each oil-soluble dye on a reflective support.

6. The silver halide photographic material of item 3, comprising a first oil-soluble dye having a hue angle $h_{ab}$ of 270 to 350 degree defined in a CIELAB color space and a second oil-soluble dye having a hue angle $h_{ab}$ of 240 to 320 degree, each hue angle $h_{ab}$ being measured using a normalized spectral transparent density curve obtained from a sample coated with each oil-soluble dye on a reflective support.

7. The silver halide photographic material of item 2, comprising an oil-soluble dye selected from the group consisting of anthraquinone dyes having a maximum absorption wavelength of a spectral reflection density curve in a range of not less than 550 nm, and an amount of the oil-soluble dye is in a range of 0.5 to 20 mg/m$^2$.

8. The silver halide photographic material of item 2, comprising an oil-soluble dye selected from the group consisting of triarylmethane dyes, and an amount of the oil-soluble dye is in a range of 0.01 to 5 mg/m$^2$.

9. The silver halide photographic material of item 2, comprising a first oil-soluble dye selected from the group consisting of anthraquinone dyes and a second oil-soluble dye selected from the group consisting of triarylmethane dyes.

10. The silver halide photographic material of item 2, comprising a first oil-soluble dye selected from the group consisting of phthalocyanine dyes and a second oil-soluble dye selected from the group consisting of anthraquinone dyes and triarylmethane dyes.

11. An ink-jet recording sheet comprising a support having thereon an ink absorbing layer comprising two oil-soluble dyes each having a maximum absorption wavelength of a spectral reflection density curve in a range of 550 to 645 nm.

12. The ink-jet recording sheet of item 11, comprising an oil-soluble dye selected from the group consisting of anthraquinone dyes having a maximum absorption wavelength of a spectral reflection density curve in a range of not less than 550 nm, and an amount of the oil-soluble dye is in a range of 0.5 to 20 mg/m$^2$.

13. The ink-jet recording sheet of item 11, comprising an oil-soluble dye selected from the group consisting of triarylmethane dyes, and an amount of the oil-soluble dye is in a range of 0.01 to 5 mg/m$^2$.

14. The ink-jet recording sheet of item 11, comprising a first oil-soluble dye selected from the group consisting of anthraquinone dyes and a second oil-soluble dye selected from the group consisting of triarylmethane dyes.

15. The ink-jet recording sheet of item 11, comprising a first oil-soluble dye selected from the group consisting of phthalocyanine dyes and a second oil-soluble dye selected from the group consisting of anthraquinone dyes and triarylmethane dyes.

16. The ink-jet recording sheet of item 11, comprising an oil-soluble dye having a maximum absorption wavelength of a spectral reflection density curve in a range of 540 to 580 nm and exhibiting an absorption density at 440 nm of not more than ¼ of an absorption density at the maximum absorption wavelength.

17. The ink-jet recording sheet of item 11, comprising two oil-soluble dyes each exhibiting an absorption density at 440 nm of a spectral reflection density curve of not more than ⅕ of an absorption density at a maximum absorption wavelength.

18. The ink-jet recording sheet of item 11, comprising a first oil-soluble dye having a hue angle $h_{ab}$ of 270 to 350 degree defined in a CIELAB color space and a second oil-soluble dye having a hue angle $h_{ab}$ of 240 to 320 degree, each hue angle $h_{ab}$ being measured using a normalized spectral transparent density curve obtained from a test sample having a reflective support coated thereon with the first oil-soluble dye or the second oil-soluble dye.

DETAILED DESCRIPTION OF THE INVENTION

In the following paragraphs, the present invention will be detailed.

Oil-soluble dyes of this invention are basically insoluble in water, but can be dissolved in adequate amounts of organic solvents such as ethyl acetate, toluene, xylene, dibutyl phthalate, tricresyl phosphate and dibutyl sebacate, and the dyes refer to organic dyes of which the solubility in water (g/water 100 g) is not more than $1\times10^{-2}$ at 20° C. Exemplary compounds include anthraquinon compounds, triarylmethane compounds, azo compounds and phthalocyanine compounds.

In the present invention, spectral reflection density of oil-soluble dyes is measured by the following method. An oil-soluble dye of the invention in the amount of 0.1 weight part is dissolved in a dibutyl phthalate solution of 50 weight parts and ethyl acetate of 50 weight parts, and then the solution is dispersed in a 10% gelatin solution of 200 weight parts containing 5 weight parts of dodecylbenzene sulfonic acid. The resulting solution is coated onto RC paper and dried to obtain measurement sample. Spectral reflection density of the sample can be measured by a method known in the art, by which spectral reflection density and λmax are determined. The sample can thus be measured using a spectrophotometer having an integrating sphere and a white board as a reference.

An oil-soluble dye of the invention is added to couplers and other organic compounds, and after emulsifying the dispersion, the solution is added to a photographic material of the invention. An oil-soluble dye can be added to any layer comprised of a photographic material of the invention other than the support. The dye can be added to one layer or more than 2 layers, and optimally added to silver halide emulsion layers or other hydrophilic colloid layers.

One of embodiments of this invention is to use at least two oil-soluble dyes having a λmax in the range of 550 to 640 nm. Thus, in cases even when more than two RC papers having different white background tones are used, a white background of color paper after a photographic processing can be adjusted to high lightness and a bluish white background as preferred by customers by controlling each coverage of more than two oil-soluble dyes in the emulsion layer. In cases when the dye is used only one, it is not easy to adjust all white backgrounds of color papers after processing using more than two RC papers. Even when using two oil-soluble dyes, but more than one dye is a dye having a λmax out of the range of 550 to 650 nm of this invention, the bluish white background can hardly be obtained, or lightness is extremely lowered even being bluish white, resulting in being far from the white background preferred by customers. An oil-soluble dye having λmax of a spectral reflection density curve in the range of 540 to 645 nm is selected from the color index of Solvent Violet dyes and Solvent Blue dyes.

Examples include Solvent Violet8, Solvent Violet9, Solvent Violet11, Solvent Violet12, Solvent Violet13, Solvent Violet14, Violet15, Solvent Violet30, Solvent Blue2, Solvent Blue4, Solvent Blue5, Solvent Blue6, Solvent Blue10, Solvent Blue11, Solvent Blue15, Solvent Blue19, Solvent Blue36, Solvent Blue65, Solvent Blue66, Solvent Blue84, and Solvent Blue87, but are not limited to these examples.

The total added amount of more than 2 oil-soluble dyes of the invention, having a λmax of a spectral reflection density in the range of 550 to 645 nm added to a photographic material of the invention is preferably 0.1 to 20 mg/m$^2$, and more preferably 0.5 to 10 mg/m$^2$.

An anthraquinone oil-soluble dye of the invention, having a λmax of a spectral reflection density of more than 550 nm, is preferably an anthraquinone oil-soluble dye having λmax of a spectral reflection density in the range of 550 to 645 nm. Examples include Solvent Violet13, Solvent Violet14, Solvent Blue11, Solvent Blue12, Solvent Blue59, Solvent Blue76, Solvent Blue85, and Solvent Blue87, but are not limited to these samples.

The total added amount of more than one anthraquinone oil-soluble dye having a λmax of a spectral reflection density in the range of 550 to 645 nm added to a photographic material of the invention is preferably 0.5 to 20 mg/m$^2$, and more preferably 0.8 to 5 mg/m$^2$.

A triarylmethane oil-soluble dye of the invention is preferably a dye having a λmax of a spectral reflection density in the range of 550 to 645 nm. Examples include Solvent Violet8, Solvent Violet9, Solvent Blue3, Solvent Blue4, Solvent Blue5, Solvent Blue23, Solvent Blue71, Solvent Blue72, and Solvent Blue81, but are not limited to these examples.

The total added amount of more than one triarylmethane oil-soluble dyes having a λmax of a spectral reflection density in the range of 550 to 645 nm added to a photographic material of the invention is preferably 0.01 to 5 mg/m$^2$, and more preferably 0.05 to 1 mg/m$^2$.

In a photographic material of the invention containing more than one anthraquinone oil-soluble dye of the invention and more than one triarylmethane oil-soluble dye of the invention, anthraquinone oil-soluble dyes having a λmax of a spectral reflection density of not more than 550 nm can be employed in addition to the foregoing anthraquinone oil-soluble dyes having a λmax of a spectral reflection density in the range of 550 to 645 nm. The foregoing triarylmethane oil-soluble dyes can be employed as triarylmethane dyes.

In this case, the added amount of anthraquinone oil-soluble dye added to a photographic material of the invention is preferably 0.1 to 10 mg/m$^2$, and the added amount of triarylmethane oil-soluble dye is preferably 0.01 to 5 mg/m$^2$. The ratio of anthraquinone oil-soluble dye to the total of anthraquinone oil-soluble dye and triarylmethane oil-soluble dye is preferably 50% or more.

Subsequently, a photographic material of the invention containing more than one dye selected from anthraquinone oil-soluble dyes and triarylmethane oil-soluble dyes, and more than one dye of phthalocyanine oil-soluble dyes will now be explained.

Examples of anthraquinone oil-soluble dyes and triarylmethane oil-soluble dyes of this invention are listed above. Examples of phthalocyanine oil-soluble dyes of the invention include Solvent Blue24, Solvent Blue25, Solvent Blue42, Solvent Blue44, Solvent Blue55, Solvent Blue64, and Solvent Blue70, but are not limited to these examples.

The added amount of the oil-soluble dyes selected from anthraquinone oil-soluble dyes and triarylmethane oil-soluble dyes, added to a photographic material of the invention in this case, is preferably 0.01 to 10 mg/m$^2$. The added amount of phthalocyanine oil-soluble dyes is preferably 0.1 to 20 mg/m$^2$. The ratio of phthalocyanine oil-soluble dyes to the total of oil-soluble dyes is preferably not more than 40%.

Examples of oil-soluble dyes of this invention having a λmax of a spectral reflection density curve in the range of 540 to 645 nm and exhibiting a density at 440 nm of not more than ¼ of the density at λmax include Solvent Violet13 and Solvent Violet14, but are not limited to these examples.

Subsequently, exemplary examples of oil-soluble dyes exhibiting an absorption density at 440 nm of not more than ⅕ of the absorption density at λmax (the maximum absorption wavelength) of a spectral reflection density curve include Solvent Violet8, Solvent Violet13, Solvent Violet14, Solvent Blue4, Solvent Blue5, and Solvent Blue87, but are not limited to these examples. As mentioned above an absorption density at 440 nm of "not more than ¼" (or "not more than ⅕") of the absorption density at λmax, exhibits a lower limit of 0 (zero) in both cases.

Explained next will be a photographic material containing at least one oil-soluble dye having a hue angle $h_{ab}$ of 270 to 350 degrees defined in a CIELAB color space and at least one oil-soluble dye having a hue angle $h_{ab}$ of 240 to 320 degrees, each hue angle $h_{ab}$ being measured using a normalized spectral transparent density curve obtained from a sample coated with each oil-soluble dye on a reflective support.

Subject color is normally be red, green or blue (under fixed viewing conditions) with the combination of a*, b* and L*in CIELAB standard colorimetric system. Measurement of a*, b* and L* is well explained and the international standard of colorimetrics is designated. Commonly known CIE standard colorimetric system was established by the Commission Internationale de I'Eclairage in 1931, and revised in 1971. A detailed explanation is described in "Principles of Color Technology" 2nd edition, F. Billmeyer, Jr. and M. Saltzman, published by J. Wiley and Sons Co., Ltd., in 1981.

L* is a scale indicating the degree of light and shade of a specific color. L*=100 indicates white. L*=0 indicates black.

a* is a scale indicating the degree of colors of green or magenta. b* is also a scale indicating the degree of colors of blue or yellow.

Subject color can de defined more precisely using a* and b*. Hue angle of a given color can be explained by the value of degrees as described below, calculating arc-tangent of ratio of b*/a*.

$$h_{ab}=\arctan(b^*/a^*)$$

Hue angle $h_{ab}$ increases in the anticlockwise direction as a rule in definition of colorimetry. Approximate hue angle is defined in that 0 degree is red, 180 degrees is green, 90 degrees is yellow and 270 degrees is blue. Hue angle is between 0 to 360 degrees, and consequently, hue angle can include all hues of colors and can describe all color hues.

Examples of oil-soluble dyes of this invention, having a hue angle $h_{ab}$ of 270 to 350 degrees defined in a CIELAB color space, being measured using a normalized spectral transparent density curve obtained from a sample coated with the oil-soluble dye on a reflective support, include Solvent Violet8, Solvent Violet13, and Solvent Violet14, but are not limited to these examples.

Examples of oil-soluble dyes of this invention, having a hue angle $h_{ab}$ of 240 to 320 degrees defined in a CIELAB color space, being measured using a normalized spectral transparent density curve obtained from a sample coated with the oil-soluble dye on a reflective support, include Solvent Blue4, Solvent Blue5, and Solvent Blue87, but are not limited to these examples.

With regard to production of a photographic material of this invention, a slide-hopper coating apparatus is preferable as the coating means. Examples of preferable coating methods of a multi-layer coating using the coating composition of the invention include a slide-hopper bead coating method and a slide-hopper curtain coating method.

The coating rate can be set to be more than 180 m/min in terms of enhanced productivity, and also to be more than 200 m/min at high speed coating. Further, the effect of the invention can still be satisfactorily obtained at more than 250 m/min of high speed coating rate. The desired effect of the invention cannot be hindered by a coating rate of less than 180 m/min. And conversely the effect of the invention can be satisfactorily obtained in cases when the total wet thickness of coated layers is less than 100 μm, and even less than 90 μm.

With regard to production of a photographic material of this invention, viscosity of the coating composition of each layer used for a multi-layer coating is preferably 1 to 300 mPa·s. A viscosity increasing agent may be employed to enhance coating characteristics in cases when a photographic material of the invention is coated. The flow rate of each layer coating composition used for a multi-layer coating is preferably more than 0.1 ml/cm/sec at the slit exit of the slide-hopper, and the total flow rate is preferably 0.5 to 50 ml/cm/sec. Coating compositions contain water as a major solvent, and can be applied as multi-layers, simultaneous coating of 2 to 20 layers.

With regard to production of a photographic material of this invention, the surface of a support is subjected to corona discharge, ultraviolet irradiation or a flame treatment, and then the coating compositions may be applied onto the support directly or onto a subbing layer (one or more than 2 layers coated onto a support to enhance adhesion, anti-static properties, dimensional stability, abrasion resistance, hardness, anti-halation properties, friction properties and/or other properties of the support surface).

Various materials can be used for a support of a photographic material of this invention, such as paper laminated with polyethylene or polyethylene terephthalate, a paper support comprised of natural pulp or synthetic pulp, a vinyl chloride sheet, polypropylene may be contained a white pigment, polyethylene terephthalate base and baryta paper. Specifically, a support is preferable which has waterproofing resin covering layers on both sides of a base paper and contains a white pigment in the resin layer on the emulsion coating side. Polyethylene, polypropylene, polyethylene terephthalate and copolymers of these are preferred as a waterproofing resin, while polyethylene is specifically preferred.

Inorganic and/or organic white pigments can be employed for white pigments used in the resin layer on the emulsion coating side of a support, but inorganic white pigments are preferably employed. Examples of inorganic white pigments include alkaline-earth metal sulfates such as barium sulfate, alkaline-earth metal carbonates such as calcium carbonate, fine powdered silicic acid, silica such as synthetic silicate, calcium silicate, alumina, alumina hydrate, titanium oxide, zinc oxide, talc and clay. Of these, the preferable white pigments are barium sulfate and titanium oxide.

The amount of white pigment contained in a resin layer on the emulsion coating side of a support is, in terms of improving sharpness, preferably not less than 5 weight %, and more preferably not less than 8 weight %.

A red tinted pigment, a blue tinted pigment or a fluorescent brightening agent may be incorporated as an image color control agent in a resin layer on the emulsion coating side of a support, however, the raw material cost of these is raised if a red tinted pigment, a blue tinted pigment or a fluorescent brightening agent is incorporated as an image color control agent. Further, in cases when lamination of a waterproofing resin is applied to both sides of a base paper, a reduced lamination rate is required due to difficulty of lamination compared to lamination of a waterproofing resin layer containing no red tinted pigment, blue tinted pigment or a fluorescent brightening agent, consequently, the production cost increases. Further, regarding a support of waterproofing resin coated paper, it is preferred that an image color control agent such as a red tinted pigment, a blue tinted pigment and a fluorescent brightening agent is not added onto the emulsion side resin layer.

Composition of a silver halide photographic emulsion composition of a photographic material of this invention is applicable to any halogen composition such as silver chloride, silver bromide, silver chlorobromide, silver iodobromide, silver iodochlorobromide, and silver chloroiodide.

Silver halide preferably occludes heavy metal ions. Examples of heavy metal ions capable of being used for this purpose include ions of metals belonging to Groups 8, 9 and 10 of the Periodic Table such as iron, iridium, platinum, palladium, nickel, rhodium, osmium, ruthenium and cobalt; transition metals of Group 12 such as cadmium, zinc and mercury; lead; rhenium; molybdenum; tungsten; gallium and chromium. Of these, metal ions of iron, iridium, platinum, ruthenium, gallium and osmium are preferred. These metal ions can be added to a silver halide emulsion as a form of a simple salt or a complex salt.

In cases when the foregoing heavy metal ions form complexes, examples of the ligands or ions include cyanide ions, thiocyanic acid ion, isothiocyanic acid ion, cyanic acid ion, chloride ions, bromide ions, iodide ions, nitric acid ion, carbonyl and ammonia. Of these, cyanide ions, thiocyanic acid ion, isothiocyanic acid ion, chloride ions and bromide ions are preferred.

To include heavy metal ions in silver halide, heavy metal compounds may be added at any stage such as before or during silver halide grain formation, or during physical ripening after the silver halide grain formation. The heavy metal compounds may be dissolved together with halide salt and added continuously during the entire period or intermittence period during the grain formation process to obtain a silver halide emulsion to meet the foregoing conditions.

Any grain form of a silver halide can be employed. A preferable example is a cubic crystal having (100) faces on its a crystal surface. Octahedral grains, tetradecahedral grains and dodecahedral grains can be used, and may be formed by methods described in U.S. Pat. Nos. 4,183,756 and 4,225,666, JP-A 55-26589, JP-B 55-42737 (hereinafter, the term, JP-B means Japanese Patent Publication), and J. Photogr. Sci. vol. 21 (39), 1973. Further, grains having twin faces can be used. Silver halide grains comprised of a single shape are preferably used.

The grain size of silver halide grains is not specifically limited, but, when considering other photographic characteristics such as rapid processing property and sensitivity, it is preferably 0.1 to 1.2 $\mu$m, and more preferably 0.2 to 1.0 $\mu$m. The grain size is determined by using a projection area or an approximate value of diameter of grains. In cases when grains are basically uniform in shape, grain size distribution can be indicated as a diameter or a projection area.

The grain size distribution of silver halide grains is preferably not more than 0.22 of a coefficient of variation of grain size, and more preferably not more than 0.15, the silver halide grains of which are preferably monodispersed grains. It is specifically preferable to add more than 2 monodispersed emulsion having a coefficient of variation of not more than 0.15 on the same layer. In this case, the coefficient of variation is a coefficient indicating the width of grain size distribution and defined by the following formula.

$$\text{Coefficient of variation} = S/R$$

S is the standard deviation of grain size, and R is the average grain size.

Grain size as described herein refers the diameter in cases of spherical silver halide grains, and the diameter of a circle having an area equivalent to the projected area of the grain in cases of cubic grains or other than spherical grains.

Any kinds of preparation apparatus and method of silver halide emulsion commonly known in the art can be used. Silver halide emulsion can be prepared with any of several methods, such as acidic precipitation, neutral precipitation and ammoniacal precipitation. The grains can be grown at a time, or grown after formation of seed grains. Methods to form or grow seed grains may be the same or different.

Regarding the reaction mode of a soluble silver salt and a soluble halide salt, any one such as normal addition, reverse addition, double-jet addition and a combination thereof is applicable, however silver halide prepared by double-jet addition is preferred. Further, pAg controlled•double-jet addition described in JP-A 54-48521 as a kind of double-jet addition can be employed.

The following apparatuses can be applied: to supply solutions of a water-soluble silver salt and a water-soluble halide salt through adding devices provided in a reacting mother liquor as described in JP-A Nos. 57-92523 and 57-92524; to add solutions of a water-soluble silver salt and a water-soluble halide salt, continuously changing each concentration as described in German Patent Application Publication No. 2,921,164; to perform desired grain formation by maintaining constant distances among silver halide grains by concentrated ultrafiltration, and by drawing a reacting mother liquor from a reacting vessel as described in JP-B 56-501776.

Further, a silver halide solvent such as thioether can be used as necessary. Also, compounds containing a mercapto group, a heterocyclic nitrogen containing compound or a sensitizing dye can be added during grain formation of silver halide grains or after grain formation completed.

A silver halide emulsion can be sensitized with a combination of sensitization using a gold compound and a chalcogen sensitizer.

Examples of chalcogen sensitizers applicable to a silver halide emulsion include sulfur sensitizer, selenium sensitizer and tellurium sensitizer, of which the sulfur sensitizer is preferred. Examples of sulfur sensitizers include thiosulfate, arylthiocarbamidethiourea, arylisothiocyanate, cystin, p-toluenethiosufonate, rhodanine and inorganic sulfur.

Examples of gold sensitizers include chloroauric acid, gold sulfide and various gold complexes. Examples of ligand compounds include dimethylrhodanine, thiocyanic acid, mercaptotetrazole and mercaptotriazole.

Reduction sensitization may be applied to a silver halide emulsion as chemical sensitization. Commonly known anti-fogging agents and stabilizers can be added to a silver halide emulsion to prevent fogging caused during preparation of a silver halide photographic material, to minimize variation during storage, or to prevent fogging during photographic processing. Examples of preferable compounds used for these purposes are compounds represented by formula (II) described in the lower column of p. 7 in JP-A 2-146036, while examples of more preferable compounds include compounds represented by formula (IIa-1) to (IIa-8) and (IIb-1) to (IIb-7) described on p. 8 of the same JP-A, and further, compounds such as 1-(3-methoxyphenyl)-5-mercaptotetrazole and 1-(4-ethoxyphenyl)-5-mercaptotetrazole are also preferred. These compounds can be added optionally during any process of silver halide grains such as during the preparation process, during or after the chemical sensitization process, and during the preparation process of coating compositions.

Employed as a surface-sensitive silver halide emulsion to form latent images on silver halide surfaces by image exposure, results in formation of negative images by development process. Also, an internal latent-image-forming type silver halide emulsion, the silver halide grain surface of which is not fogged in advance, can be employed to obtain a direct positive image, formed by providing a fogging process (nucleating process) after image exposure followed by surface development, or by surface development with the fogging process after image exposure. The internal latent-image-forming type silver halide emulsion refers to an emulsion containing silver halide grains having sensitivity specks mainly inside the silver halide grains, which form latent images on the interior of grains via light exposure.

Dyes exhibiting absorption in various wavelength regions can be employed in a photographic material of this invention for the purpose of anti-irradiation or anti-halation. For this, commonly known compounds can be used, such as dyes of AI-1 to 11 described on p. 308 of JP-A 3-251840, and dyes described in JP-A 6-3770 are preferably used as dyes exhibiting absorption in the visible wavelength region. As for infrared absorbing dyes, compounds represented by formulas (I), (II) and (III) described in the lower left column of p. 2 in JP-A 1-280750 are preferred since they exhibit preferable spectral characteristics, exhibit reduced affects to photographic characteristics of a silver halide emulsion, and show less staining by dye residue. Examples of preferable compounds include exemplified compounds of (1) to (45) described in the lower left column of p. 3 to the lower left column of p. 5 in the same JP-A.

The added amount of these dyes is preferably in an amount which exhibits a spectral reflection density at 680 nm of not less than 0.7 before photographic processing to improve sharpness, and more preferably not less than 0.8.

A photographic material of this invention comprises layers containing spectral sensitized silver halide emulsions sensitized to given regions of 400 to 900 nm, combined with a yellow coupler, a magenta coupler and a cyan coupler. The silver halide emulsion may combine one or two sensitizing dyes.

Any of the commonly known spectral sensitizing dyes can be used for a silver halide emulsion. Dyes of BS-1 to 8 described in JP-A 3-251840 p. 28 can preferably be used alone or combined as blue sensitive spectral sensitizing dyes. Dyes of GS-1 to 5 described in the same JP-A p. 28 are preferably used as green sensitive spectral sensitizer. Dyes of RS-1 to 8 described in the same JP-A p. 29 are preferably used as red sensitive spectral sensitizer. In cases when an image exposure is conducted by infrared light using a semiconductor laser, an infrared sensitive spectral sensitizer is necessary. Dyes of IRS-1 to 11 described in JP-A 4-285950 pp. 6 to 8 are preferably used as an infrared sensitive spectral sensitizer. It is preferred to use these infrared, red, green and blue sensitive spectral sensitizers in combination with any of the super sensitizer SS-1 to SS-9 described in JP-A 4-285950 pp. 8 and 9, or compounds of S-1 to S-17 described in JP-A 5-66515 pp. 15 to 17.

The timing of adding these sensitizing dyes is at any time from the formation period to the end of chemical sensitization of the silver halide grains. The sensitizing dyes can be added as a solution dissolved in a water miscible solvent such as methanol, ethanol, fluorinated alcohol, acetone and dimethylformamide, or water, and can also be added as a solid dispersion.

Any compounds which can form a coupling product having a spectral absorption maximum wavelength in the longer wavelength regions of more than 340 nm, by a coupling reaction with an oxidant of a color developing agent, can be employed as couplers used in the photographic material of this invention. Specifically typical couplers are yellow dye forming couplers having a maximum spectral absorption wavelength in the wavelength band of 350 to 500 nm, magenta dye forming couplers having a maximum spectral absorption wavelength in the wavelength band of 500 to 600 nm, and cyan dye forming couplers having a maximum spectral absorption wavelength in the wavelength band of 600 to 750 nm.

Couplers represented by formulas (C-1) or (C-II) described in the lower left column of p. 5 in JP-A 4-114154 are listed as cyan couplers preferably employed in the photographic material of this invention. Examples of compounds include CC-1 to CC-9 described in the lower right column of p. 5 to the lower left column of p. 6 in the same JP-A.

Couplers represented by formulas (M-I) or (M-II) described in the upper right column of p. 4 in JP-A 4-114154 are listed as cyan couplers preferably employed in the photographic material of this invention. Examples of compounds include MC-1 to MC-11 described in the lower left column of p. 4 to the upper right column of p. 6 in the same JP-A. Of the foregoing magenta couplers, the preferred couplers are ones represented by formula (M-I) described in the upper right column of p. 4 in the same JP-A, and further, of these, couplers having an RM of a tertiary alkyl group in formula (M-I) above that exhibiting superior light-stability are specifically preferred. MC-8 through MC-11 described in the upper column of p. 5 in the same JP-A are preferable due to excellent color reproduction in colors of blue to purple and red, and also an excellent representation property of details.

Couplers represented by formula (Y-I) described in the upper right column of p. 3 in JP-A 4-114154 are listed as cyan couplers preferably employed in the photographic material of this invention. Examples of compounds include YC-1 through YC-9 described in the lower left column of pp. 4 and following pages in the same JP-A. Of these, couplers having an RY1 of an alkoxyl group in formula

[Y-1] described in the same JP-A and couplers represented by formula [I] described in JP-A 6-67388 are more preferable due to desirable yellow reproduction of color tone. Of these couplers, YC-8, YC-9 and No. (1) through (47) described in JP-A 6-67388 pp. 13 and 14 are listed as specifically preferred compounds. Further, examples of specifically preferable compounds include the compounds represented by formula [Y-1] described in JP-A 4-818471 p. 1 and pp. 11 through 17.

In cases when couplers and other organic compounds used for a photographic material of this invention are added by an oil-in-water type emulsifying dispersion method, they are usually dissolved in a water-insoluble high boiling solvent exhibiting a boiling point of more than 150° C., in combination with a low boiling point and/or water-soluble organic solvent if needed, and are dispersed in a hydrophilic binder such as a gelatin solution using a surfactant by an emulsifying dispersion method. A stirrer, homogenizer, colloid mill, flow jet mixer or ultrasonic homogenizer can be used as the dispersion means. A low boiling point solvent removing process can be provided after or during dispersion.

Examples of high boiling solvents used for dissolving and dispersion of couplers include phthalates such as dioctyl phthalate, diisodecyl phthalate, and dibuthyl phthalate as well as phosphates such as tricresyl phosphate and trioctyl phosphate. The dielectric constant of high boiling solvents is preferably 3.5 to 7.0. Further, more than 2 high boiling solvents can be combined.

Instead of using a high boiling organic solvent, or in combination with a high boiling organic solvent, couplers can be dissolved in a water-insoluble and also organic solvent-soluble polymer compound, optionally dissolved in a low boiling solvent and/or a water-soluble organic solvent, and thus, dispersed in a hydrophilic binder such as a gelatin solution using a surfactant by an emulsifying dispersion method using any of several dispersion means. An example of this water-soluble and organic solvent-soluble polymer is poly(N-t-butylacrylamide).

Examples of surfactants used for dispersion of photographic additives and adjustment of surface tension during coating include compounds containing a hydrophobic group having 8 to 30 carbons and a sulfonyl group, or its salt, in a molecule. Listed examples are A-1 through A-11 described in JP-A 64-26854. Also, a surfactant substituted by a fluorine atom in an alkyl group is preferably used. These dispersion solutions are usually added to a coating composition containing a silver halide emulsion. The period of the dispersion solutions added to a coating composition after dispersion and until to coating, is preferably short. The preferred period is within 10 hr. for each, and within 3 hr. is more preferable, and within 20 min. is still more preferable.

Anti-fading agents are preferably combined with couplers to prevent fading of formed dye images by light, heat and moisture. Specifically preferable compounds are phenyl ether compounds represented by formulas I and II as described in JP-A 2-66541 p.3, phenol compounds represented by formula III B as described in JP-A 3-174150, amine compounds represented by formula A as described in JP-A 64-90445 and metal complexes represented by formulas XII, XIII, XIV and XV described in JP-A 62-182741, being especially preferred for magenta dyes. Further, compounds represented by formula I' described in JP-A 1-196049 and formula II described in JP-A 5-11417 are specifically preferable for yellow dyes and cyan dyes.

Compounds of (d-11) described in the lower left column of p. 9 in JP-A 4-114154 and (A'-1) described in the lower left column of p. 10 in the same JP-A can be used to shift absorption wavelengths of formed dyes. Other than these, fluorescent dye releasing compounds described in U.S. Pat. No. 4,774,187 are also used.

In the photographic material of this invention, preferably added to a layer between light sensitive layers to prevent color contamination, and to a silver halide emulsion layer to improve fogging are compounds reacting with an oxidant of a color developing agent. These compounds are preferably hydroquinone derivatives, and more preferably are dialkyl hydroquinones such as 2,5-di-t-octyl hydroquinone. Specifically preferable compounds are represented by formula II described in JP-A 4-133056, and listed are compounds of II-1 through II-14 on pp. 13 and 14 and compound 1 on p. 17.

In the photographic material of this invention, it is preferred to add ultraviolet absorption agents to prevent electrostatic fogging and to improve light stability of dye images. Preferable ultraviolet absorption agents are benzotriazoles, and specifically preferred are compounds represented by formula III-3 described in JP-A 1-250944, by formula III described in JP-A 64-66646, compounds of UV-1L to UV-27L described in JP-A 63-187240, and ones represented by formula I described in JP-A 4-1633 and by formulas (I) and (II) described in JP-A 5-165144.

Gelatin is used as a binder in the photographic material of this invention, and optionally used in combination with gelatin are gelatin derivatives, graft copolymers of gelatin and other polymers, proteins other than gelatin, saccharide, cellulose derivatives, and hydrophobic colloids such as mono- or copolymers of synthesized hydrophobic high polymers.

The total gelatin amount contained in the photographic material of the invention is preferably not more than 7 g/m$^2$ to enhance speeding-up of the processing process and the drying process, and is more preferably not more than 6.5 g/m$^2$. The lower limit is not specifically restricted, but generally, the amount is preferably not more than 4.0 g/m$^2$ in terms of physical properties and photographic characteristics. The amount of gelatin is determined by the weight converted to 11.0% water content gelatin measured by the water content measuring method described in PAGI Method of Gelatin.

Jelly strength (using the PAGI Method) of gelatin used in this invention is preferably not less than 250 g, and more preferably not less than 270 g. Calcium content (using the PAGI Method) of gelatin is preferably not more than 10,000 ppm. Usually an ion-exchange resin column treatment is preferably employed to decrease calcium amount in gelatin. Molecular weight of gelatin is not specifically limited, but an average molecular weight is preferably 1 to 200,000.

Gelatin used in this invention may be a liming process gelatin or acid process gelatin, and produced from the raw material of cattle bone, ox hide or pig skin, but preferable gelatin is a liming process gelatin produced from bovine bone and swine skin.

Vinyl sulfone type hardening agents, chlorotriazine type hardening agents, high polymer hardening agents and carboxyl group activated type hardening agents may preferably be used alone or in combination with others as hardening agents of these binders. It is preferable to use compounds described in JP-A Nos. 61-249054 and 61-245153. Addition of an antiseptic agent and a fungicide described in JP-A 3-157646 to colloidal layers is preferable to prevent propagation of mildew and bacteria causing adverse effects on photographic characteristics and image lasting property. Also, slippage agents and matting agents described in JP-A Nos. 6-118543 and 2-73250 are preferably added to a protective layer to improve surface properties of a photographic material or photo-processed samples.

When photographic images are formed using the photographic material of this invention, recorded images on a negative film may be optically focused to print on the silver halide photographic material for printing; or the images are once converted to digital data and focused on CRT (cathode ray tube), and then focused to print on the silver halide photographic material for printing; or printed by scanning laser light to change the intensity based on the digital data.

This invention is preferably applied to photographic material which does not contain a color developing agent, and is specifically preferred to be applied to photographic material to form images for direct observation. Examples include color paper, color reversal paper, light sensitive material to form positive images, light sensitive material for displays and light sensitive material for color proofing. Specifically this invention is preferably applied to light sensitive material having a reflection-type support.

Commonly known compounds are used as aromatic primary amine color developing agents. Examples of these compounds are listed below.

CD-1: N,N-diethyl-p-phenylenediamine

CD-2: 2-amino-5-diethylaminotoluene

CD-3: 2-amino-5-(N-ethyl-N-laurylamino)toluene

CD-4: 4-(N-ethyl-N-(β-hydroxyethyl)amino)aniline

CD-5: 2-methyl-4-(N-ethyl-N-(β-hydroxyethyl)amino) aniline

CD-6: 4-amino-3-methyl-N-ethyl-N-(β-(methanesulfonamide)ethyl)-aniline

CD-7: N-(2-amino-5-diethylaminophenylethyl) ethanesulfonamide

CD-8: N,N-dimethyl-p-phenylenediamine

CD-9: 4-amino-3-methyl-N-thyl-N-methoxyethylaniline

CD-10: 4-amino-3-methyl-N-ethyl-N-(β-ethoxyethyl) aniline

CD-11: 4-amino-3-methyl-N-ethyl-N-(γ-hydroxypropyl) aniline

In this invention, the above compounds are used in any pH region of a color developing solution, but in terms of high-speed processing, pH is preferably 9.5 to 13.0, and more preferably 9.8 to 12.0.

The processing temperature during color development is preferably 35 to 70° C. A higher temperature range is preferable for a shorter processing time. However, not exceeding the temperature range is preferable from the color developer stability point of view, and thus, the processing temperature range is preferably 37 to 60° C. Color development duration is usually about 3 min. 30 sec., but is preferably less 40 sec. in this invention, and more preferably less 25 sec.

In addition to the foregoing color developing agents, well known compounds of color developer components can be added to the color developing solution. Usually added are alkali agents and chloride ions having pH buffer action, development inhibitors such as benzotriazoles, preserving agents and chelating agents.

The photographic material of this invention is subjected to a bleaching process and a fixing process after a color developing process. The bleaching process may be simultaneously performed with a fixing process. Usually a water washing process is provided after the fixing process, and a stabilizing process may be provided instead of a water washing process.

A photographic processing apparatus may be a roller transport type processor transferring a photographic material by nipping between rollers arranged in the apparatus tanks or an endless-belt type processor transferring the photographic material by placement on a belt. Further, a processor transferring photographic material through a slit clearance type processing tanks provided with processing solutions therein, a spray processing processor spraying a photographic material with misted processing solutions, a web method processor contacting a photographic material with a solid support impregnated with a processing solution, and a viscous processing solution method processor can be applied as appropriate.

In cases when a large volume of photographic material is processed, an automatic processor is usually employed for the running process. In this case, the replenishing rate of a replenisher is preferably reduced, and thus the specifically preferable embodiment of a replenishing method is to add processing solution in a tablet form. The method described in Research Disclosure 94-16935 is one of the most preferable methods.

In cases when this invention is applied to the photographic material for color proofs, it is preferable when forming images to use an automatic processor of a light source scanning exposure type. Specifically preferable examples of image forming apparatus include Konsensus L, Konsensus 570 and Konsensus II, manufactured by Konica Corp.

Embodiments described from paragraphs [0041] line 43 on the left side of p. 10f to [0074] line 21 on the right side of p. 13 in JP-A 2001-158164 can be applied as preferable embodiments of an ink-jet recording sheet of this invention. One of the examples of exemplary embodiments is recording sheet 1 described in Example 1 in the same JP-A.

EXAMPLES

The present invention will be further explained based on examples, but it is not limited to these examples.

Example 1

Preparation of Silver Halide Photographic Material

Polyethylene was laminated onto both sides of 160 g/m$^2$ pulp paper sheets to obtain resin coated paper A (hereinafter, also referred to as RC paper). On the emulsion coating side of the RC paper, melted polyethylene in which surface-treated anatase type titanium oxide was dispersed in the amount of 14 weight %, after which a fluorescent brightening agent, a red tinted pigment and a blue tinted pigment were incorporated, were laminated to prepare RC paper A. After this RC paper A was subjected to corona discharge, a gelatin subbing layer having gelatin laydown of 50 mg/m$^2$ was provided, and then, each layer of the composition indicating in following Tables 1 and 2 was coated thereon to form a total wet layer thickness of 75 μm to obtain a silver halide photographic material. The coating was applied using a curtain method at a coating rate of 210 m/min. The coating compositions were prepared as followed.

The first layer coating composition was prepared as follows.

Ethyl acetate 60 ml was added to dissolve yellow coupler (Y-1) 23.4 g, dye-image stabilizer (ST-1) 3.34 g, dye-image stabilizer (ST-2) 3.34 g, dye-image stabilizer (ST-5) 3.34 g, anti-staining agent (HQ-1) 0.34 g, image stabilizer A 5.0 g, high boiling organic solvent (DBP) 5.0 g and high boiling organic solvent (DNP) 1.67 g, after which the resulting solution was dispersed into 7% gelatin solution 320 ml containing 10% surfactant (SU-1) 5 ml using an ultrasonic homogenizer to obtain 500 ml of a yellow coupler dispersion solution. This dispersion solution was mixed with a blue sensitive silver halide emulsion prepared under the following conditions to obtain the 1st layer coating composition.

The 2nd through 7th layer coating compositions were each prepared in the same manner to contain the stated amounts of additives as shown in Tables 1 and 2.

Further, (H-1) and (H-2) were added as hardening agents. Surfactants (SU-2) and (SU-2) were added as coating aids to adjust surface tension. Furthermore, (F-1) was added to each layer to bring the total amount to 0.04 mg/m$^2$.

TABLE 1

| Layer | Constituent | Added amount (g/m$^2$) |
|---|---|---|
| The 7th layer (Protective layer) Wet layer thickness 7 μm | Gelatin | 0.700 |
| | DBP | 0.002 |
| | DIDP | 0.002 |
| | Silicon dioxide | 0.003 |
| The 6th layer (Ultraviolet absorption layer) Wet layer thickness 5 μm | Gelatin | 0.450 |
| | AI-1 | 0.010 |
| | Ultraviolet absorption agent (UV-1) | 0.120 |
| | Ultraviolet absorption agent (UV-2) | 0.040 |
| | Ultraviolet absorption agent (UV-3) | 0.160 |
| | Anti-staining agent (HQ-5) | 0.040 |
| | PVP | 0.030 |
| The 5th layer (Red sensitive layer) Wet layer thickness 13 μm | Gelatin | 1.200 |
| | Red sensitive silver halide emulsion (Em-R) | 0.210 |
| | Cyan coupler (C-1) | 0.250 |
| | Cyan coupler (C-2) | 0.080 |
| | Dye image stabilizer (ST-1) | 0.010 |
| | Anti-staining agent | 0.004 |
| | DBP | 0.100 |
| | DOP | 0.200 |
| The 4th layer (Ultraviolet absorption layer) Wet layer thickness 10 μm | Gelatin | 0.950 |
| | AI-1 | 0.020 |
| | Ultraviolet absorption agent (UV-1) | 0.280 |
| | Ultraviolet absorption agent (UV-2) | 0.090 |
| | Ultraviolet absorption agent (UV-3) | 0.380 |
| | Anti-staining agent (HQ-5) | 0.100 |
| The 3rd layer (Green sensitive layer) Wet layer thickness 14 μm | Gelatin | 1.300 |
| | Green sensitive silver halide emulsion Em-G) | 0.140 |
| | AI-2 | 0.010 |
| | Magenta coupler (M-1) | 0.200 |
| | Dye image stabilizer (ST-3) | 0.200 |
| | Dye image stabilizer (ST-4) | 0.170 |
| | DBP | 0.130 |
| | DIDP | 0.130 |

TABLE 2

| Layer | Constituent | Added amount (g/m$^2$) |
|---|---|---|
| The 2nd layer (Inter layer) Wet layer thickness 12 μm | Gelatin | 1.100 |
| | AI-3 | 0.010 |
| | Anti-staining agent (HQ-2) | 0.030 |
| | Anti-staining agent (HQ-3) | 0.030 |
| | Anti-staining agent (HQ-4) | 0.050 |
| | Anti-staining agent (HQ-5) | 0.023 |
| | DBP | 0.020 |
| | DIDP | 0.040 |
| The 1st layer (Blue sensitive layer) Wet layer thickness | Gelatin | 1.200 |
| | Blue sensitive silver halide emulsion (Em-B) | 0.260 |
| | Yellow coupler (Y-1) | 0.700 |
| | Dye image stabilizer (ST-1) | 0.100 |
| | Dye image stabilizer (ST-2) | 0.100 |
| | Dye image stabilizer (ST-5) | 0.100 |
| | Anti-staining agent (HQ-1) | 0.010 |
| | Image stabilizer A | 0.150 |
| | DBP | 0.150 |
| | DNP | 0.050 |
| Support | Mentioned above | |

The added amounts of the silver halide emulsions were indicated by the amount converted into silver.

SU-1: tri-I-sodium propylnaphthalenesulfonate

SU-2: di(2-ethylhexyl)sulfosuccinate•sodium salt

SU-3: di(2,2,3,3,4,4,5,5-octafluoropentyl) sulfosuccinate•sodium salt

DBP: dibutylphthalate

DNP: dinonylphthalate

DOP: dioctylphthalate

DIDP: di-i-decylphthalate

PVP: polyvinyl pyrrolidone

H-1: (vinylsulfonylethyl)methane

H-2: 2,4-dichloro-6-hydroxy-s-triazine•natrium

HQ-1: 2,5-di-t-octylhydroquinone

HQ-2: 2,5-di-sec-dodecylhydroquinone

HQ-3: 2,5-di-sec-tetradecylhydroquinone

HQ-4: 2-sec-dodecyl-5-sec-tetradecylhydroquinone

HQ-5: 2,5-di-[(1,1-dimethyl-4-hexyloxycarbonyl)butyl] hydroquinone

Image stabilizer A: p-t-octylphenol

Y-1

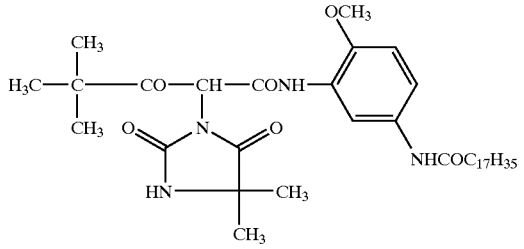

M-1

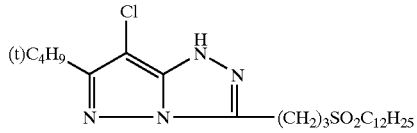

-continued
C-1
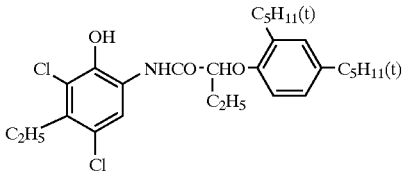
C-2
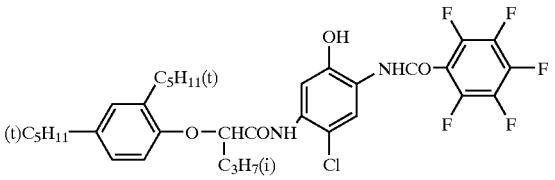
ST-1
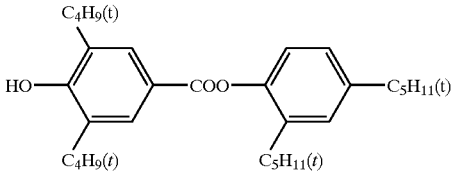
ST-2
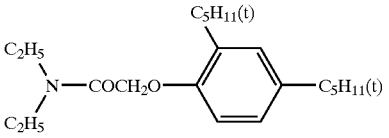
ST-3
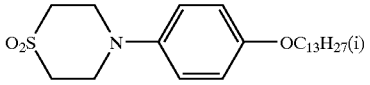
ST-4
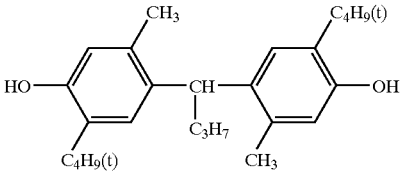
ST-5
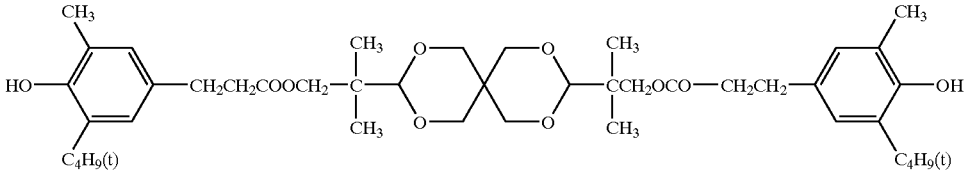
UV-1
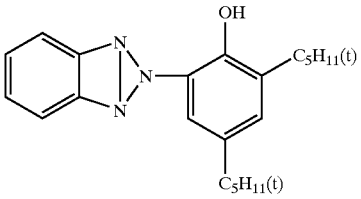
UV-2
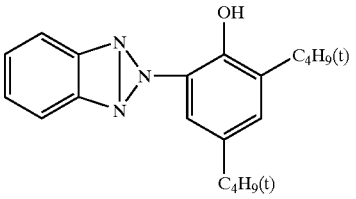
UV-3
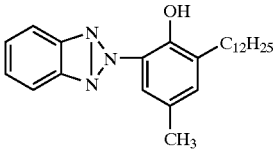
AI-1
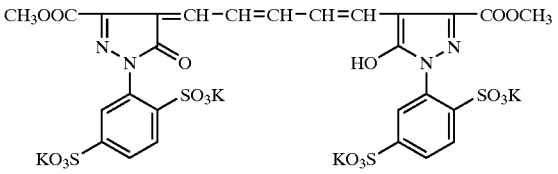
AI-2
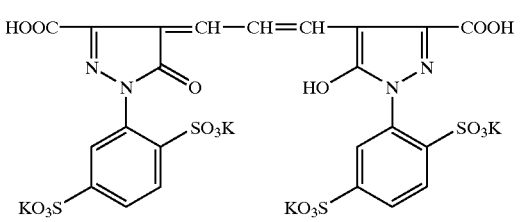
AI-3
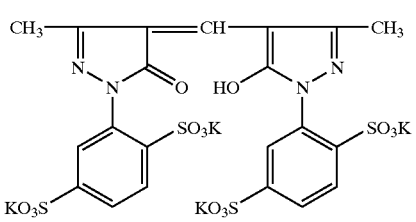
F-1
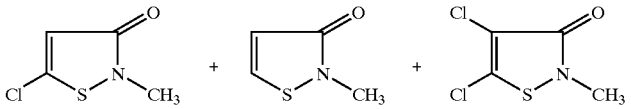
(50%) (46%) (4%) mol ratio Preparation of Blue Sensitive Silver Halide Emulsion Following (solution A) and (solution B) were simultaneously added into 1L of 2% gelatin solution maintained 40° C. over 30 min. while controlling pAg=7.3 and pH=3.0. Further, following (solution C) and (solution D) were simultaneously added over 180 min. while controlling pAg=8.0 and pH=5.5. The control of pAg was accomplished by the method described in JP-A 59-45437, and the control of pH was done employing sulfuric acid or sodium hydroxide solution.

| | |
|---|---|
| (Solution A) | |
| Sodium chloride | 3.42 g |
| Potassium bromide | 0.03 g |
| Water to make | 200 ml |
| (Solution B) | |
| Silver nitrate | 10 g |
| Water to make | 200 ml |
| (Solution C) | |
| Sodium chloride | 102.7 g |
| $K_2IrCl_6$ | $4 \times 10^{-8}$ mol/mol Ag |
| $K_4Fe(CN)_6$ | $2 \times 10^{-5}$ mol/mol Ag |
| Potassium bromide | 1.0 g |
| Water to make | 600 ml |
| (Solution D) | |
| Silver nitrate | 300 g |
| Water to make | 600 ml |

After the additions were completed, desalting was conducted using 5% solution of Demol N produced by Kao Atlas Co., Ltd. and 20% solution of magnesium sulfate, and then gelatin solution was mixed to obtain mono dispersed cubic crystal emulsion EMP-1 having an average grain size of 0.71 μm, a coefficient of variation of grain size of 0.07 and a silver chloride content of 99.5 mol %.

Consequently, mono dispersed cubic crystal emulsion EMP-1B having an average grain size of 0.64 μm, a coefficient of variation of grain size of 0.07 and a silver chloride content of 99.5 mol % was obtained in the same manner as preparation of EMP-1 except that the addition time of (solution A) and (solution B), and that of (solution C) and (solution D) were changed.

Above EMP-1 was optimally subjected to chemical sensitization using the following compounds at 60° C. After EMP-1B also was optimally subjected to chemical sensitization in the same manner, sensitized EMP-1 and EMP-1B were mixed at a silver content ratio of 1:1 to obtain blue sensitive silver halide emulsion (Em-B).

| | |
|---|---|
| Sodium thiosulfate | 0.8 mg/mol AgX |
| Chloroauric acid | 0.5 mg/mol AgX |
| Stabilizer STAB-1 | $3 \times 10^{-4}$ mol/mol AgX |
| Stabilizer STAB-2 | $3 \times 10^{-4}$ mol/mol AgX |
| Stabilizer STAB-3 | $3 \times 10^{-4}$ mol/mol AgX |
| Sensitizer BS-1 | $4 \times 10^{-4}$ mol/mol AgX |
| Sensitizer BS-2 | $1 \times 10^{-4}$ mol/mol AgX |

Preparation of Green Sensitive Silver Halide Emulsion

Monodispersed cubic crystal emulsion EMP-2 having an average grain size of 0.40 μm, a coefficient of variation of grain size of 0.08 and a silver chloride content of 99.5 mol % was obtained in the same manner as preparation of EPM-1 except that the addition time of (solution A) and (solution B), and that of (solution C) and (solution D) were changed.

Further, mono dispersed cubic crystal emulsion EMP-2B having an average grain size of 0.50 μm, a coefficient of variation of grain size of 0.08 and a silver chloride content of 99.5 mol % was obtained in the same manner.

Above EMP-2 was optimally subjected to chemical sensitization using the following compounds at 55° C. After EMP-2B also was optimally subjected to chemical sensitization in the same manner, sensitized EMP-1 and EMP-1B were mixed at a silver content ratio of 1:1 to obtain green sensitive silver halide emulsion (Em-G).

| | |
|---|---|
| Sodium thiosulfate | 1.5 mg/mol AgX |
| Chloroauric acid | 1.0 mg/mol AgX |
| Stabilizer STAB-1 | $3 \times 10^{-4}$ mol/mol AgX |
| Stabilizer STAB-2 | $3 \times 10^{-4}$ mol/mol AgX |
| Stabilizer STAB-3 | $3 \times 10^{-4}$ mol/mol AgX |
| Sensitizer GS-1 | $4 \times 10^{-4}$ mol/mol AgX |

Preparation of Red Sensitive Silver Halide Emulsion

Mono dispersed cubic crystal emulsion EMP-3 having an average grain size of 0.40 μm, a coefficient of variation of grain size of 0.08 and a silver chloride content of 99.5 mol % was obtained in the same manner as preparation of EMP-1 except that the addition time of (solution A) and (solution B), and that of (solution C) and (solution D) were changed. Further, mono dispersed cubic crystal emulsion EMP-3B having an average grain size of 0.38 μm, a coefficient of variation of grain size of 0.08 and a silver chloride content of 99.5 mol % was obtained in the same manner.

Above EMP-3 was optimally subjected to chemical sensitization using the following compounds at 60° C. After EMP-3B was also optimally subjected to chemical sensitization in the same manner, sensitized EMP-3 and EMP-3B were mixed at a silver content ratio of 1:1 to obtain green sensitive silver halide emulsion (Em-R).

| | |
|---|---|
| Sodium thiosulfate | 1.8 mg/mol AgX |
| Chloroauric acid | 2.0 mg/mol AgX |
| Stabilizer STAB-1 | $3 \times 10^{-4}$ mol/mol AgX |
| Stabilizer STAB-2 | $3 \times 10^{-4}$ mol/mol AgX |
| Stabilizer STAB-3 | $3 \times 10^{-4}$ mol/mol AgX |
| Sensitizer RS-1 | $1 \times 10^{-4}$ mol/mol AgX |
| Sensitizer RS-2 | $1 \times 10^{-4}$ mol/mol AgX |

STB-1: 1-(3-acetamidephenyl)-5-mercaptotetrazole
STB-2: 1-phenyl-5-mercaptotetrazole
STB-3: 1-(4-ethoxyphenyl)-5-5-mercaptotetrazole Further, SS-1 was added into the red sensitive silver halide emulsion in the amount of $2.0 \times 10^{-3}$ mol per mol of silver halide.

BS-1

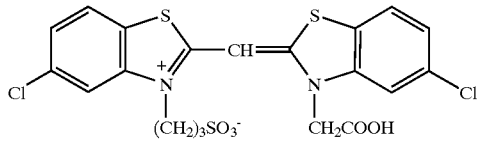

-continued

BS-2

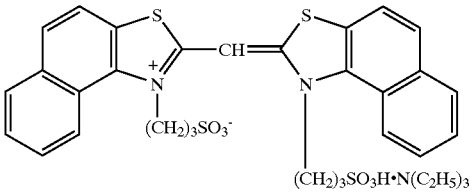

GS-1

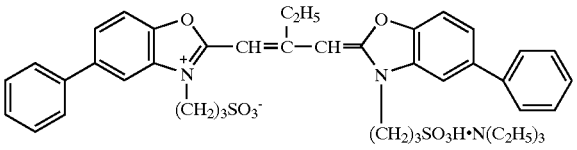

RS-1

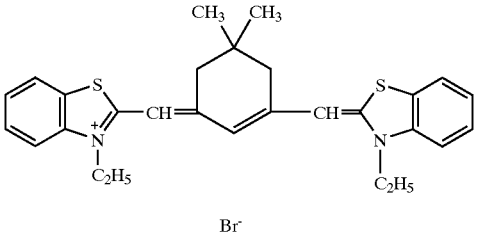

RS-2

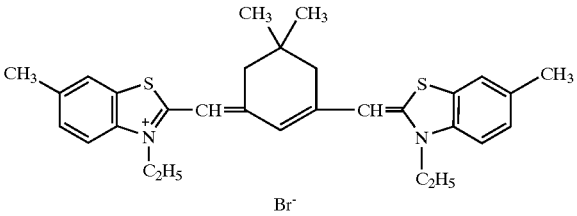

SS-1

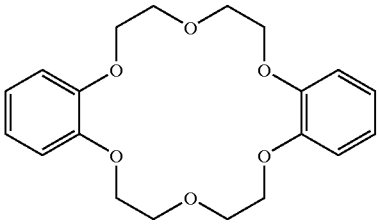

The thus obtained sample was designated sample 101. Next, polyethylene was laminated onto both sides of 160 g/m$^2$ pulp paper, on which an emulsion coating side melt polyethylene was laminated containing surface-treated anatase type titanium oxide dispersed in the amount of 14 weight % and not containing a fluorescent brightening agent, a blue tinted pigment and a red tinted pigment for adjusting a white background to obtain RC paper B.

Thereafter, the 1st through 7th layer of sample 101 were applied onto RC paper B in the same manner as preparation of sample 101 to obtain sample 102.

Consequently, samples 103 through 108 were prepared in the same manner as sample 102 except that the oil-soluble dyes of the invention or comparison of (CA-1 and CA-2) were added to the 4th layer and the 6th layer shown in Table 4 which were subjected to emulsifying dispersion together with the ultraviolet absorption agents added in the 4th and 6th layers of sample 102.

Next, polyethylene was laminated onto both sides of 160 g/m$^2$ pulp paper, on the emulsion coating side of which melt polyethylene was laminated containing surface-treated anatase type titanium oxide dispersed in the amount of 10 weight % and not containing a fluorescent brightening agent, a blue tint pigment and a red tint pigment for adjusting a white background, to obtain RC paper C.

Thereafter, the 1st through 7th layers of sample 101 were applied onto RC paper C in the same manner as preparation of sample 101 to obtain sample 109.

Consequently, samples 110 through 114 were prepared in the same manner as sample 109 except that the oil-soluble dyes of the invention or comparison of (CA-1 and CA-2) were added to the 4th layer and the 6th layer shown in Table 4 which were subjected to emulsifying dispersion together with the ultraviolet absorption agents added in the 4th and 6th layers of sample 109. Sample S1 to S4 were also prepared in accordance to the manner as other samples. They contain one dye in each layer.

The λmax and the density at 440 nm/density at λmax of the used oil-soluble dyes were indicated in Table 3.

TABLE 3

| Oil-soluble dye | λ max (nm) | Density at 440 nm/Density at λmax |
|---|---|---|
| CA-1 | 520 | 0.325 |
| CA-2 | 648 | 0.025 |
| Solvent Violet8 | 600 | 0.135 |
| Solvent Violet13 | 570 | 0.100 |
| Solvent Violet14 | 560 | 0.160 |
| Solvent Blue4 | 610 | 0.120 |
| Solvent Blue5 | 600 | 0.070 |
| Solvent Blue87 | 630 | 0.060 |
| Solvent Blue70 | 670 | 0.060 |

TABLE 4

| | | Oil-soluble dye added to the 4th layer | | Oil-soluble dye added to the 6th layer | | |
|---|---|---|---|---|---|---|
| Sample | Support | Dye | Amount mg/m$^2$ | Dye | Amount mg/m$^2$ | Remarks |
| 101 | RC Paper A | — | — | — | — | Comp. |
| 102 | RC Paper B | — | — | — | — | Comp. |
| 103 | RC Paper B | CA-1<br>CA-2 | 1.10<br>1.05 | CA-1<br>CA-2 | 0.40<br>0.35 | Comp. |
| 104 | RC Paper B | Solvent Violet14<br>Solvent Blue87 | 1.40<br>0.49 | Solvent Violet14<br>Solvent Blue87 | 0.60<br>0.21 | Inv. |
| 105 | RC paper B | Solvent Violet13<br>Solvent Blue4 | 1.33<br>0.11 | Solvent Violet13<br>Solvent Blue4 | 0.56<br>0.04 | Inv. |
| 106 | RC Paper B | Solvent Violet13<br>Solvent Blue5 | 1.30<br>0.12 | Solvent Violet13<br>Solvent Blue5 | 0.50<br>0.05 | Inv. |
| 107 | RC Paper B | Solvent Violet13<br>Solvent Blue87 | 1.40<br>0.45 | Solvent Violet13<br>Solvent Blue87 | 0.60<br>0.20 | Inv. |
| 108 | RC Paper B | Solvent Violet14<br>Solvent Blue4 | 1.40<br>0.12 | Solvent Violet14<br>Solvent Blue4 | 0.60<br>0.05 | Inv. |
| 109 | RC Paper C | — | — | — | — | Comp. |
| 110 | RC Paper C | CA-1<br>CA-2 | 1.10<br>1.05 | CA-1<br>CA-2 | 0.40<br>0.35 | Comp. |
| 111 | RC Paper C | Solvent Violet14 | 1.40 | Solvent Violet14 | 0.60 | Inv. |

TABLE 4-continued

| Sample | Support | Oil-soluble dye added to the 4th layer: Dye | Amount mg/m² | Oil-soluble dye added to the 6th layer: Dye | Amount mg/m² | Remarks |
|---|---|---|---|---|---|---|
| | | Solvent Blue87 | 0.50 | Solvent Blue87 | 0.25 | |
| 112 | RC Paper C | Solvent Violet13 | 1.33 | Solvent Violet13 | 0.56 | Inv. |
| | | Solvent Blue4 | 0.15 | Solvent Blue4 | 0.06 | |
| 113 | RC Paper C | Solvent Violet13 | 1.30 | Solvent Violet13 | 0.50 | Inv. |
| | | Solvent Blue5 | 0.14 | Solvent Blue5 | 0.06 | |
| 114 | RC Paper C | Solvent Violet13 | 1.40 | Solvent Violet13 | 0.60 | Inv. |
| | | Solvent Blue87 | 0.50 | Solvent Blue87 | 0.20 | |
| S1 | RC Paper B | Solvent Blue4 | 0.30 | Solvent Blue4 | 0.20 | Inv. |
| S2 | RC Paper C | Solvent Blue4 | 0.50 | Solvent Blue4 | 0.30 | Inv. |
| S3 | RC Paper B | Solvent Blue8 | 0.40 | Solvent Blue8 | 0.20 | Inv. |
| S4 | RC Paper C | Solvent Blue8 | 0.70 | Solvent Blue8 | 0.30 | Inv. |

Comp.; Comparative example
Inv.: Inventive example

CA-1

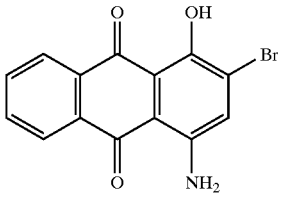

CA-2

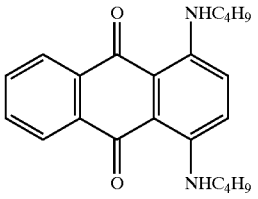

Evaluation of Sharpness

All samples were printed the resolution test chart by red, green and blue light each, and were subjected to a photographic processing as described in paragraphs [0231] to [0235] in JP-A 11-338108. The obtained cyan image, magenta image and yellow image were measured in color by Micro Densitometer PMD-5D (manufactured by Konica Corp.), and thus the value determined by the following formula was referred to as sharpness.

Sharpness (%)=(*Dmax–Dmin* of dense line print image at 3 lines/*mm*)/(*Dmax–Dmin* of large area portion)

Dmax: maximum density

Dmin: minimum density

The bigger value means the better sharpness, and the little differences of the values among cyan image, magenta image and yellow image can provide the better print quality. The results were shown in Table 5.

Evaluation of White Background

All unexposed samples were subjected to the foregoing photographic processing to make white background samples, and the thus obtained samples were observed whiteness by visual observation under the daylight condition of D65. Evaluation was conducted by 15 standard observers based on the following criteria of 4 steps (A: bluish white with high lightness, B: bluish white but with slightly low lightness, C: looks slightly gray with low lightness, D: deviates from the aim tone of bluish white).

Viewing Light Source Dependency of White Background

All unexposed samples were subjected to the foregoing photographic processing to make white background samples, and the thus obtained samples were compared under the 3 viewing conditions of a) daylight (D65 light source), b) a white lamp (light source of A) and c) daylight fluorescent lamp F8 (color rendition AAA, daylight), to evaluate viewing light source dependency of a white background. Evaluation was conducted by 15 standard observers and represented by the average mark of [A]: viewing light source dependency was little enough not to feel unpleasant sensation at all, [B]: viewing light source dependency was slight and no problem in practice, and [C]: viewing light source dependency was large. The results were shown in Table 5.

TABLE 5

| Sample | Sharpness (%) [3 lines/mm]: Cyan image | Magenta image | Yellow image | Sensory evaluation of white background | Sensory evaluation of viewing light source dependency | Remarks |
|---|---|---|---|---|---|---|
| 101 | 0.644 | 0.668 | 0.711 | A | C | Comp. |
| 102 | 0.640 | 0.670 | 0.720 | D | B | Comp. |
| 103 | 0.671 | 0.684 | 0.710 | C | B | Comp. |
| 104 | 0.691 | 0.705 | 0.721 | A | A | Inv. |
| 105 | 0.698 | 0.711 | 0.725 | A | A | Inv. |
| 106 | 0.695 | 0.706 | 0.722 | A | A | Inv. |
| 107 | 0.688 | 0.707 | 0.720 | A | A | Inv. |
| 108 | 0.698 | 0.707 | 0.725 | A | A | Inv. |
| 109 | 0.635 | 0.672 | 0.725 | D | B | Comp. |
| 110 | 0.640 | 0.685 | 0.727 | C | B | Comp. |
| 111 | 0.690 | 0.708 | 0.725 | A | A | Inv. |
| 112 | 0.695 | 0.715 | 0.726 | A | A | Inv. |
| 113 | 0.690 | 0.706 | 0.720 | A | A | Inv. |
| 114 | 0.690 | 0.710 | 0.722 | A | A | Inv. |
| S1 | — | — | — | A | A | Inv. |
| S2 | — | — | — | B | B | Inv. |
| S3 | — | — | — | B | B | Inv. |
| S4 | — | — | — | A | A | Inv. |

Comp.: Comparative example
Inv.: Inventive example
—: not measured

It was proved from Table 5 that the samples using the oil-soluble dyes having λmax (a maximum absorption wavelength) of its spectral reflection density curve in the range of 550 to 645 nm exhibited excellent sharpness and could be obtained better print quality due to small differences among 3 color image sharpness. Further, it was proved that an excellent white background and small viewing light source dependency of a white background could be obtained.

Example 2

Samples 201 and 202 were prepared in the same manner as sample 109 except that the oil-soluble dye of the invention or a comparison of (CA-1) were added to the 4th layer and the 6th layer as shown in Table 6, which dyes were subjected to emulsifying dispersion together with the ultraviolet absorption agents added in the 4th and 6th layers of sample 109 of Example 1.

TABLE 6

| Sample | Support | Oil-soluble dye added to the 4th layer: Dye | Amount mg/m² | Oil-soluble dye added to the 6th layer: Dye | Amount Mg/m² | Remarks |
|---|---|---|---|---|---|---|
| 201 | RC Paper C | CA-1 | 2.50 | CA-1 | 1.10 | Comp. |
| 202 | RC Paper C | Solvent Violet13 | 1.70 | Solvent Violet13 | 0.70 | Inv. |

Comp.; Comparative example
Inv.: Inventive example

Samples 201 and 202 were evaluated in the same manners as Example 1. The results were shown in Table 7.

TABLE 7

| Sample | Sharpness (%) [3 lines/mm] cyan image | magenta image | yellow image | Sensory evaluation of white background | Sensory evaluation of viewing light source dependency | Remarks |
|---|---|---|---|---|---|---|
| 201 | 0.655 | 0.691 | 0.727 | D | C | Comp. |
| 202 | 0.685 | 0.712 | 0.715 | A | A | Inv. |

Comp.; Comparative example
Inv.: Inventive example

It was proved from Table 7 that the sample using anthraquinone oil-soluble dye having λmax (a maximum absorption wavelength) of its spectral reflection density curve in the range of 550 to 645 nm exhibited excellent sharpness and could be obtained better print quality due to small differences among 3 color image sharpness. Further, it was proved that an excellent white background and small viewing light source dependency of a white background could be obtained.

Example 3

Samples 301 and 302 were prepared in the same manner as sample 109 except that triarylmethane oil-soluble dyes of this invention were added to the 4th layer and the 6th layer as shown in Table 8, which dyes were subjected to emulsifying dispersion together with the ultraviolet absorption agents added in the 4th and 6th layers of sample 109 of Example 1.

TABLE 8

| Sample | Support | Oil-soluble dye added to the 4th layer: Dye | Amount mg/m² | Oil-soluble dye added to the 6th layer: Dye | Amount mg/m² | Remarks |
|---|---|---|---|---|---|---|
| 301 | RC paper C | Solvent Violet8 | 0.70 | Solvent Blue4 | 0.30 | Inv. |
| 302 | RC paper CC | Solvent Blue4 | 0.60 | Solvent Blue4 | 0.25 | Inv. |

Inv.: Inventive example

Samples 301 and 302 were evaluated in the same manners as Example 1. The results were shown in Table 9.

TABLE 9

| Sample | Sharpness (%) [3 lines/mm] cyan image | magenta image | yellow image | Sensory evaluation of white background | Sensory evaluation of viewing light source dependency | Remarks |
|---|---|---|---|---|---|---|
| 301 | 0.692 | 0.708 | 0.712 | A | B | Inv. |
| 302 | 0.681 | 0.715 | 0.712 | A | B | Inv. |

Inv.: Inventive example

It was proved from Table 9 that the samples using triarylmethane oil-soluble dyes exhibited excellent sharpness and could be obtained better print quality due to small differences among 3 color image sharpness. Further, it was proved that an excellent white background and small viewing light source dependency of a white background could be obtained.

Example 4

Samples 401 and 402 were prepared in the same manner as sample 109 except that anthraquinone oil-soluble dyes and triarylmethane oil-soluble dyes of this invention were added to the 4th layer and the 6th layer as shown in Table 10, which dyes were subjected to emulsifying dispersion together with the ultraviolet absorption agents added in the 4th and 6th layers of sample 109 of Example 1.

TABLE 10

| Sample | Support | Oil-soluble dye added to the 4th layer: Dye | Amount mg/m² | Oil-soluble dye added to the 6th layer: Dye | Amount mg/m² | Remark |
|---|---|---|---|---|---|---|
| 401 | RC paper C | Solvent Violet13 | 1.20 | Solvent Violet14 | 0.50 | Inv. |
| | | Solvent Violet8 | 0.50 | Solvent Violet8 | 0.20 | |
| 402 | RC paper C | Solvent Violet14 | 1.30 | Solvent Violet8 | 0.50 | Inv. |
| | | Solvent Blue5 | 0.10 | Solvent Blue4 | 0.05 | |

Inv.: Inventive example

Samples 401 and 402 were evaluated in the same manners as Example 1. The results were shown in Table 11.

TABLE 11

| Sample | Sharpness (%) [3 lines/mm] cyan image | magenta image | yellow image | Sensory evaluation of white background | Sensory evaluation of viewing light source dependency | Remarks |
|---|---|---|---|---|---|---|
| 401 | 0.685 | 0.711 | 0.710 | A | A | Inv. |
| 402 | 0.693 | 0.710 | 0.716 | A | A | Inv. |

Inv.: Inventive example

It was proved from Table 11 that the samples using anthraquinone oil-soluble dyes and triarylmethane oil-soluble dyes exhibited excellent sharpness and could be obtained better print quality due to small differences among 3 color image sharpness. Further, it was proved that an excellent white background and small viewing light source dependency of a white background could be obtained.

Example 5

Samples 501 and 502 were prepared in the same manner as sample 109 except that the oil-soluble dyes of this invention were added to the 4th layer and the 6th layer as shown in Table 12, which dyes were subjected to emulsifying dispersion together with the ultraviolet absorption agents added in the 4th and 6th layers of sample 109 of Example 1.

TABLE 12

| | | Oil-soluble dye added to the 4th layer | | Oil-soluble dye added to the 6th layer | | |
|---|---|---|---|---|---|---|
| Sample | Support | Dye | Amount Mg/m$^2$ | Dye | Amount Mg/m$^2$ | Remarks |
| 501 | RC paper C | Solvent Violet14 | 1.40 | Solvent Violet14 | 0.60 | Inv. |
| | | Solvent Blue70 | 0.70 | Solvent Blue70 | 0.30 | |
| 502 | RC paper C | Solvent Violet14 | 1.20 | Solvent Violet14 | 0.50 | Inv. |
| | | Solvent Blue4 | 0.15 | Solvent Blue4 | 0.05 | |
| | | Solvent Blue70 | 0.70 | Solvent Blue70 | 0.30 | |

Inv.: Inventive example

Samples 501 and 502 were evaluated in the same manners as Example 1. The results were shown in Table 13.

TABLE 13

| | Sharpness (%) [3 lines/mm] | | | Sensory evaluation of white | Sensory evaluation of viewing light | |
|---|---|---|---|---|---|---|
| Sample | cyan image | magenta image | yellow image | back-ground | source dependency | Remarks |
| 501 | 0.695 | 0.711 | 0.717 | A | A | Inv. |
| 502 | 0.692 | 0.715 | 0.710 | A | A | Inv. |

Inv.: Inventive example

It was proved from Table 13 that the samples using at least one dye selected from anthraquinone oil-soluble dyes and triarylmethane oil-soluble dyes of this invention and phthalocyanine dyes of this invention exhibited excellent sharpness and could be obtained better print quality due to small differences among 3 color image sharpness. Further, it was proved that an excellent white background and small viewing light source dependency of a white background could be obtained.

Example 6

Sample 601 was prepared in the same manner as sample 109 except that Solvent Violet14 relevant to the oil-soluble dye of this invention having a λmax of a spectral reflection density curve in the range of 540 to 580 nm and exhibiting a density at 440 nm of not more than ¼ of the density at λmax, was added to the 4th layer and the 6th layer in the amount as shown in Table 14, which dye was subjected to emulsifying dispersion together with the ultraviolet absorption agents added in the 4th and 6th layers of sample 109 of Example 1.

TABLE 14

| | | Oil-soluble dye added to the 4th layer | | Oil-soluble dye added to the 6th layer | | |
|---|---|---|---|---|---|---|
| Sample | Support | Dye | Amount Mg/m$^2$ | Dye | Amount Mg/m$^2$ | Remarks |
| 601 | RC paper C | Solvent Violet14 | 1.70 | Solvent Violet14 | 0.70 | Inv. |

Inv.: Inventive example

Sample 601 was evaluated in the same manners as Example 1. The results were shown in Table 15.

TABLE 15

| | Sharpness (%) [3 lines/mm] | | | Sensory evaluation of white | Sensory evaluation of viewing | |
|---|---|---|---|---|---|---|
| Sample | cyan image | magenta image | yellow image | back-ground | light source dependency | Remarks |
| 601 | 0.675 | 0.702 | 0.715 | A | B | Inv. |

Inv.: Inventive example

It was proved from Table 15 that the sample using the oil-soluble dye of this invention having a λmax of a spectral reflection density curve in the range of 540 to 580 nm and exhibiting a density at 440 nm of not more than ¼ of the density at λmax, exhibited excellent sharpness and could be obtained better print quality due to small differences among 3 color image sharpness. Further, it was proved that an excellent white background and small viewing light source dependency of a white background could be obtained.

Example 7

Sample 701 was prepared in the same manner as sample 109 except that Solvent Violet8, Solvent Violet14 and Solvent Blue87 which were relevant to the oil-soluble dyes of this invention exhibiting a spectral reflection density at 440 nm of not more than ⅕ of the density at λmax, were added to the 4th layer and the 6th layer in the amount shown in Table 16, which dyes were subjected to emulsifying dispersion together with the ultraviolet absorption agents added in the 4th and 6th layers of sample 109 of Example 1.

TABLE 16

| | | Oil-soluble dye added to the 4th layer | | Oil-soluble dye added to the 6th layer | | |
|---|---|---|---|---|---|---|
| Sample | Support | Dye | Amount Mg/m$^2$ | Dye | Amount Mg/m$^2$ | Remarks |
| 701 | RC paper C | Solvent Violet14 | 1.20 | Solvent Violet8 | 0.40 | Inv. |
| | | Solvent Blue87 | 0.70 | | | |

Inv.: Inventive example

Samples 701 was evaluated in the same manners as Example 1. The results were shown in Table 17.

TABLE 17

| Sample | Sharpness (%) [3 lines/mm] cyan image | magenta image | yellow image | Sensory evaluation of white back-ground | Sensory evaluation of viewing light source dependency | Remarks |
|---|---|---|---|---|---|---|
| 701 | 0.695 | 0.715 | 0.720 | A | A | Inv. |

Inv.: Inventive example

It was proved from Table 13 that the sample using the oil-soluble dyes of this invention exhibiting a spectral reflection density at 440 nm of not more than ⅕ of the density at λmax, exhibited excellent sharpness and could be obtained better print quality due to small differences among 3 color image sharpness. Further, it was proved that an excellent white background and small viewing light source dependency of a white background could be obtained.

Example 8

Sample 801 was prepared in the same manner as sample 109 except that Solvent Violet14 ($h_{ab}$=ca. 325°) relevant to the oil-soluble dyes of this invention having a hue angle $h_{ab}$ of 270 to 350 degrees defined in a CIELAB color space and Solvent Blue5 ($h_{ab}$=ca. 265°) relevant to the oil-soluble dyes of this invention having a hue angle $h_{ab}$ of 240 to 320 degrees defined in a CIELAB color space, being measured using a normalized spectral transparent density curve, were added to the 4th layer and the 6th layer in the amounts shown in Table 18, which dyes were subjected to emulsifying dispersion together with the ultraviolet absorption agents added in the 4th and 6th layers of sample 109 of Example 1.

TABLE 18

| Sample | Support | Oil-soluble dye added to the 4th layer Dye | Amount Mg/m² | Oil-soluble dye added to the 6th layer Dye | Amount Mg/m² | Remarks |
|---|---|---|---|---|---|---|
| 801 | RC paper C | Solvent Violet14 | 1.20 | Solvent Violet14 | 0.50 | Inv. |
| | | Solvent Blue5 | 0.20 | Solvent Blue5 | 0.10 | |

Inv.: Inventive example

Sample 801 was evaluated in the same manners as Example 1. The results were shown in Table 19.

TABLE 19

| Sample | Sharpness (%) [3 lines/mm] cyan image | magenta image | yellow image | Sensory evaluation of white back-ground | Sensory evaluation of viewing light source dependency | Remarks |
|---|---|---|---|---|---|---|
| 801 | 0.688 | 0.712 | 0.720 | A | A | Inv. |

Inv.: Inventive example

It was proved from Table 19 that the sample using the oil-soluble dye of this invention having a hue angle $h_{ab}$ of 270 to 350 degrees defined in a CIELAB color space and the oil-soluble dye of this invention having a hue angle $h_{ab}$ of 240 to 320 degrees defined in a CIELAB color space, being measured using a normalized spectral transparent density curve, exhibited excellent sharpness and could be obtained better print quality due to small differences among 3 color image sharpness. Further, it was proved that an excellent white background and small viewing light source dependency of a white background could be obtained.

Example 9

A voids containing white polyethylene terephthalate base of basis weight 170 g/m² was prepared. The coating compositions used for samples 104 to 108 of Example 1 in this invention were provided onto the voids containing white polyethylene terephthalate base, and the thus obtained samples were subjected to a photographic processing without exposure, to evaluate the white background in the same manner as Example 1. All evaluations were "A". From this, it was proved that the excellent white backgrounds were obtained even when the support was changed from Examples 1 and 2.

Example 10

Preparation of Ink-jet Recording Sheet

Preparation of Silica Dispersion Solution-1

125 Kg of gas phase silica having an average diameter of about 0.007 μm of primary particles (produced by NIPPON AEROSIL CO., LTD.) was dispersed into 620 L of water adjusting pH=3.0 with nitric acid at a room temperature by suction dispersion using Jet-stream•Inductor Mixer TDS (manufactured by Mitamura Riken Kogyo Co., Ltd.), and then, added water to make 694 L.

Preparation of Silica Dispersion Solution-2

69.4 L of silica dispersion solution-1 was added to 18 L of a solution (pH=3.0) containing 1.63 Kg of the following cation polymer P-1, 2.2 L of ethanol and 1.5 L of propaol with stirring, consequently 7.0 L of a solution containing 260 g of boric acid and 230 g of borax, further 1 g of an anti-foaming agent (SN381 produced by Sunopco Corp.). The mixed solution was dispersed with a high pressure homogenizer (manufactured by Sanwa Industry Co., Ltd.), and added water to make 97 L to obtain silica dispersion solution-2.

P-1

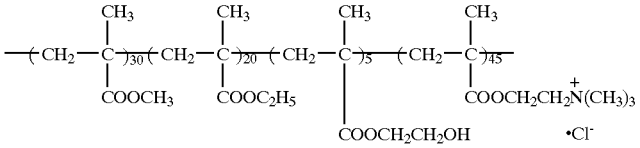

Preparation of Silica Dispersion Solution-3

Silica dispersion solution-3 was prepared in the same manner as preparation of silica dispersion solution-2 except that cation polymer P-1 of silica dispersion solution-2 was changed to cation polymer P-2 and added amounts of boric acid and borax were changed to 200 g and 210 g.

P-2

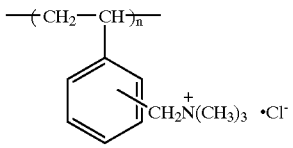

Preparation of Titanium Oxide Dispersion Solution

25 Kg of titanium oxide W-10 (produced by ISHIHARA SANGYO KAISHA LTD.) was added to 75 L of a solution containing 1 L of 5% aqueous solution of sodium tripolyphosphate, 10 L of polyvinyl alcohol (PVA235), 3 ml of anti-foaming agent (SN381) and 1.5 Kg of cation polymer (P-1), and the mixture was dispersed using a high pressure homogenizer, and water was added to make 100 L, to obtain a titanium oxide dispersion solution.

Preparation of Oil Dispersion Solution-1

34 Kg of di-i-decylphtjalate and 45 L of ethyl acetate were added to 270 L of a solution containing 11 Kg of acid process gelatin, 10 Kg of cation polymer (P-1) and 11 Kg of saponin at 50° C., and then, the mixture was dispersed to emulsion using a high pressure homogenizer, and water was added to make 380 L to obtain an oil dispersion solution-1.

Preparation of Coating Composition

The following 4 coating compositions were prepared.

| Coating Composition for 1st Layer (the Lowermost Layer) | |
|---|---|
| Silica dispersion solution-2 | 600 ml |
| 10% aqueous solution of polyvinyl alcohol (PVA203) | 6.1 ml |
| 5% aqueous solution of polyvinyl alcohol (PVA235) | 260 ml |
| Oil dispersion solution-1 | 29 ml |
| Titanium oxide dispersion solution | 33 ml |
| Cation latex (AE-803: product of Showa Highpolymer Co., Ltd.) | 36 ml |
| Water to make | 1,000 ml |
| (Coating composition pH = 4.5) | |
| Coating Composition for 2nd Layer | |
| Silica dispersion solution-2 | 670 ml |
| 10% aqueous solution of polyvinyl alcohol (PVA203) | 6.1 ml |
| 5% aqueous solution of polyvinyl alcohol (PVA235) | 240 ml |
| Oil dispersion solution-1 | 41 ml |
| Cation latex AE-803: product of Showa Highpolymer Co., Ltd.) | 11 ml |
| Water to make | 1,000 ml |
| (Coating composition pH = 4.5) | |
| Coating Composition for 3rd Layer | |
| Silica dispersion solution-3 | 630 ml |
| 10% aqueous solution of polyvinyl alcohol (PVA203) | 6.1 ml |

-continued

| | |
|---|---|
| 5% aqueous solution of polyvinyl alcohol (PVA235) | 260 ml |
| Oil dispersion solution-1 | 41 ml |
| Cation latex AE-803: product of Showa Highpolymer Co., Ltd.) | 11 ml |
| Water to make | 1,000 ml |
| (Coating composition pH = 4.5) | |
| Coating Composition for 4th Layer (the Uppermost Layer) | |
| Silica dispersion solution-3 | 610 ml |
| 10% aqueous solution of polyvinyl alcohol (PVA203) | 6.1 ml |
| 5% aqueous solution of polyvinyl alcohol (PVA235) | 270 ml |
| Silicon oil dispersion solution (BY-22-830: product of Dow Corning Toray Silicone Co., Ltd.) | 16 ml |
| 50% aqueous solution of saponin | 2 ml |
| Water to make | 1,000 ml |
| (Coating composition pH=4.5) | |

A support of the foregoing RC paper A was provided a gelatin subbing layer of 0.05 g/m$^2$ gelatin on the side of containing anatase type titanium oxide, and a back layer comprising of 0.2 g/m$^2$ of latex polymer having Tg of about 80° C. on the other side. On the gelatin subbing layer, the above coating compositions for the 1st to 4th layer were applied as 4-layer-simultaneous-coating so as to 45 $\mu$m each of wet layer thickness, and once cooled to about 7° C. followed by a drying process blowing 20 to 65° C. warmed air, to obtain ink-jet recording sheet 1001 (sample No.).

Consequently, samples 1002 to 1014 were prepared in the same manner as sample 1001 except that the dyes were added in the combinations and the added amounts; such as, dyes added to the 4th and 6th layer as describer in Table 4 of Example 1 were added to the oil dispersion solution of 2nd and 3rd layer of sample 1001; dyes of the 4th layer were added to the oil dispersion solution for the 2nd layer; and dyes of the 6th layer were added to the oil dispersion solution for the 3rd layer. Each combination of dyes in samples 102 to 114 of Table 4 was responding to that of samples 1002 to 1014.

Above samples were evaluated in the same manners as Example 1 on a white background and viewing light source dependency of a white background. The results were shown in Table 20.

TABLE 20

| Sample No. | Evaluation of white background | Viewing light source dependency of white background | Remarks |
|---|---|---|---|
| 1001 | A | C | Comp. |
| 1002 | D | B | Comp. |
| 1003 | C | B | Comp. |
| 1004 | A | A | Inv. |
| 1005 | A | A | Inv. |
| 1006 | A | A | Inv. |
| 1007 | A | A | Inv. |
| 1008 | A | A | Inv. |
| 1009 | D | B | Comp. |
| 1010 | C | B | Comp. |

TABLE 20-continued

| Sample No. | Evaluation of white background | Viewing light source dependency of white background | Remarks |
|---|---|---|---|
| 1011 | A | A | Inv. |
| 1012 | A | A | Inv. |
| 1013 | A | A | Inv. |
| 1014 | A | A | Inv. |

Comp.; Comparative example
Inv.: Inventive example

It was proved from Table 20 that the samples using the oil-soluble dyes of this invention having λmax (a maximum absorption wavelength) of its spectral reflection density curve in the range of 550 to 645 nm exhibited an excellent white background and small viewing light source dependency of a white background compared with comparative samples.

Example 11

Similarly, samples 1101 and 1102 were prepared to add the oil-soluble dyes in the same combination as samples 201 and 202 of Example 2, to the oil dispersion solution for the 2nd and 3rd layer of sample 1009 in Example 10. The evaluated results of these samples were shown in Table 21.

TABLE 21

| Sample No. | Evaluation of white background | Viewing light source dependency of white background | Remarks |
|---|---|---|---|
| 1101 | D | C | Comp. |
| 1102 | A | A | Inv. |

Comp.; Comparative example
Inv.: Inventive example

It was proved from Table 21 that the sample using the oil-soluble dyes of this invention having λmax of its spectral reflection density curve in the range of 550 to 645 nm exhibited an excellent white background and small viewing light source dependency of a white background compared with a comparative sample.

Example 12

Samples 1201 and 1202 were similarly prepared to add the oil-soluble dyes in the same combinations as samples 301 and 302. The evaluation results were shown in Table 22.

TABLE 22

| Sample No. | Evaluation of white background | Viewing light source dependency of white background | Remarks |
|---|---|---|---|
| 1201 | A | B | Inv. |
| 1202 | A | B | Inv. |

Inv.: Inventive example

It was proved from Table 22 that the samples using triarylmethane oil-soluble dyes of this invention exhibited an excellent white background and small viewing light source dependency of a white background.

It was proved from Table 22 that an excellent white background and small viewing light source dependency of a white background could be obatained in the samples using triarylmethane oil-soluble dyes of this invention exhibited.

Example 13

Samples 1301 and 1302 were similarly prepared to add the oil-soluble dyes in the same combinations as samples 401 and 402. The evaluation results were shown in Table 23.

TABLE 23

| Sample No. | Evalution of white background | Viewing light source dependency of white background | Remarks |
|---|---|---|---|
| 1301 | A | A | Inv. |
| 1302 | A | A | Inv. |

Inv.: Inventive example

It was proved from Table 23 that the samples using anthraquinone oil-soluble dyes and triarylmethane oil-soluble dyes of this invention exhibited an excellent white background and small viewing light source dependency of a white background.

Example 14

Samples 1401 and 1402 were similarly prepared to add the oil-soluble dyes in the same combinations as samples 501 and 502. The evaluation results were shown in Table 24.

TABLE 24

| Sample No. | Evaluation of white background | Viewing light source dependency of white background | Remarks |
|---|---|---|---|
| 1401 | A | A | Inv. |
| 1402 | A | A | Inv. |

Inv.: Inventive example

It was proved from Table 24 that the samples using at least one dye selected from anthraquinone oil-soluble dyes and triarylmethane oil-soluble dyes of this invention together with phthalocyanine oil-soluble dyes of this invention exhibited an excellent white background and small viewing light source dependency of a white background.

Example 15

Sample 1501 was similarly prepared to add the oil-soluble dyes in the same combination as samples 601. The evaluation results were shown in Table 25.

TABLE 25

| Sample No. | Evaluation of white background | Viewing light source dependency of white background | Remarks |
|---|---|---|---|
| 1501 | A | B | Inv. |

Inv.: Inventive example

It was proved from Table 25 that the samples using the oil-soluble dye of this invention having a λmax of a spectral reflection density curve in the range of 540 to 580 nm and exhibiting a density at 440 nm of not more than ¼ of the density at λmax, exhibited an excellent white background and small viewing light source dependency of a white background.

Example 16

Sample 1601 was similarly prepared to add the oil-soluble dyes in the same combination as samples 701. The evaluation results were shown in Table 26.

TABLE 26

| Sample No. | Evaluation of white background | Viewing light source dependency of white background | Remarks |
|---|---|---|---|
| 1601 | A | A | Inv. |

Inv.: Inventive example

It was proved from Table 26 that the sample using the oil-soluble dyes of this invention exhibiting a density at 440 nm of not more than ⅕ of the density at λmax exhibited an excellent white background and small viewing light source dependency of a white background.

Example 17

Sample 1701 was similarly prepared to add the oil-soluble dyes in the same combination as samples 801. The evaluation results were shown in Table 27.

TABLE 27

| Sample No. | Evaluation of white background | Viewing light source dependency of white background | Remarks |
|---|---|---|---|
| 1701 | A | A | Inv. |

Inv.: Inventive example

It was proved from Table 27 that the sample using the oil-soluble dyes of this invention having a hue angle $h_{ab}$ of 270 to 350 degrees defined in a CIELAB color space and the oil-soluble dye of this invention having a hue angle $h_{ab}$ of 240 to 320 degrees defined in a CIELAB color space, being measured using a normalized spectral transparent density curve, exhibited an excellent white background and small viewing light source dependency of a white background.

According to the present invention, it is possible to provide a silver halide photographic material for direct observation which is low in cost, exhibits high lightness of an optimal white background, has an improved viewing light source dependency of a white background, and exhibits a little differences of a white background when a support is changed, and further exhibits superior sharpness.

What is claimed is:

1. A silver halide photographic material for direct observation comprising a support having on one side of the support, (a) a photosensitive layer comprising a silver halide emulsion; and (b) a non-photosensitive layer, wherein the photographic material comprises at least one oil-soluble dye having a maximum absorption wavelength of a spectral reflection density curve in a range of 540 to 580 nm and exhibiting an absorption density at 440 nm of not more than ¼ of an absorption density at the maximum absorption wavelength.

2. A silver halide photographic material for direct observation comprising a support having on one side of the support, (a) a photosensitive layer comprising a silver halide emulsion; and (b) a non-photosensitive layer, wherein the photographic material comprises two oil-soluble dyes each having a maximum absorption wavelength of a spectral reflection density curve in a range of 550 to 645 nm.

3. A silver halide photographic material for direct observation comprising a support having on one side of the support, (a) a photosensitive layer comprising a silver halide emulsion; and (b) a non-photosensitive layer, wherein the photographic material comprises two oil-soluble dyes each having an absorption density at 440 nm of a spectral reflection density curve of not more than ⅕ of an absorption density at a maximum absorption wavelength.

4. The silver halide photographic material of claim 1, comprising a first oil-soluble dye having a hue angle $h_{ab}$ of 270 to 350 degree defined in a CIELAB color space and a second oil-soluble dye having a hue angle $h_{ab}$ of 240 to 320 degree, each hue angle $h_{ab}$ being measured using a normalized spectral transparent density curve obtained from a test sample having a reflective support coated thereon with the first oil-soluble dye or the second oil-soluble dye.

5. The silver halide photographic material of claim 2, comprising a first oil-soluble dye having a hue angle $h_{ab}$ of 270 to 350 degree defined in a CIELAB color space and a second oil-soluble dye having a hue angle $h_{ab}$ of 240 to 320 degree, each hue angle $h_{ab}$ being measured using a normalized spectral transparent density curve obtained from a sample coated with each oil-soluble dye on a reflective support.

6. The silver halide photographic material of claim 3, comprising a first oil-soluble dye having a hue angle $h_{ab}$ of 270 to 350 degree defined in a CIELAB color space and a second oil-soluble dye having a hue angle $h_{ab}$ of 240 to 320 degree, each hue angle $h_{ab}$ being measured using a normalized spectral transparent density curve obtained from a sample coated with each oil-soluble dye on a reflective support.

7. The silver halide photographic material of claim 2, comprising an oil-soluble dye selected from the group consisting of anthraquinone dyes having a maximum absorption wavelength of a spectral reflection density curve in a range of not less than 550 nm, and an amount of the oil-soluble dye is in a range of 0.5 to 20 $mg/m^2$.

8. The silver halide photographic material of claim 2, comprising an oil-soluble dye selected from the group consisting of triarylmethane dyes, and an amount of the oil-soluble dye is in a range of 0.01 to 5 $mg/m^2$.

9. The silver halide photographic material of claim 2, comprising a first oil-soluble dye selected from the group consisting of anthraquinone dyes and a second oil-soluble dye selected from the group consisting of triarylmethane dyes.

10. The silver halide photographic material of claim 2, comprising a first oil-soluble dye selected from the group consisting of phthalocyanine dyes and a second oil-soluble dye selected from the group consisting of anthraquinone dyes and triarylmethane dyes.

* * * * *